US009460654B2

(12) United States Patent
Iida et al.

(10) Patent No.: US 9,460,654 B2
(45) **Date of Patent: *Oct. 4, 2016**

(54) SELF-LUMINOUS DISPLAY PANEL DRIVING METHOD, SELF-LUMINOUS DISPLAY PANEL AND ELECTRONIC APPARATUS

(71) Applicant: JOLED Inc., Tokyo (JP)

(72) Inventors: Yukihito Iida, Kanagawa (JP); Yutaka Mitomi, Kanagawa (JP); Mitsuru Asano, Kanagawa (JP); Tetsuo Minami, Tokyo (JP); Takao Tanikame, Kanagawa (JP); Katsuhide Uchino, Kanagawa (JP)

(73) Assignee: JOLED Inc., Tokyo (JP)

( * ) Notice: Subject to any disclaimer, the term of this patent is extended or adjusted under 35 U.S.C. 154(b) by 183 days.

This patent is subject to a terminal disclaimer.

(21) Appl. No.: 14/245,659

(22) Filed: Apr. 4, 2014

(65) Prior Publication Data

US 2014/0320548 A1 Oct. 30, 2014

Related U.S. Application Data

(63) Continuation of application No. 13/287,800, filed on Nov. 2, 2011, now Pat. No. 8,730,135, which is a continuation of application No. 12/078,798, filed on Apr. 4, 2008, now Pat. No. 8,089,430.

(30) Foreign Application Priority Data

Apr. 12, 2007 (JP) ..... 2007-104590

(51) Int. Cl.
*G09G 5/10* (2006.01)
*G09G 3/32* (2016.01)

(52) U.S. Cl.
CPC ..... *G09G 3/3225* (2013.01); *G09G 3/3233* (2013.01); *G09G 2300/0819* (2013.01); *G09G 2300/0842* (2013.01); *G09G 2310/0251* (2013.01)

(58) Field of Classification Search
CPC ..... G09G 2300/0819; G09G 2320/0233
USPC ..... 345/690, 76–77, 205, 212
See application file for complete search history.

(56) References Cited

U.S. PATENT DOCUMENTS

| | | | | |
|---|---|---|---|---|
| 6,501,455 | B1 * | 12/2002 | Nakamura | G09G 3/3685 345/87 |
| 8,144,083 | B2 * | 3/2012 | Takahashi | G09G 3/3233 315/169.3 |
| 2004/0174349 | A1 * | 9/2004 | Libsch | G09G 3/3233 345/204 |
| 2005/0212787 | A1 | 9/2005 | Noguchi et al. | |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2005-258326 | A | 9/2005 |
| JP | 2006-330223 | A | 12/2006 |

OTHER PUBLICATIONS

Japanese Office Action issued Jan. 31, 2012 for corresponding Japanese Application No. 2007-104590.

* cited by examiner

*Primary Examiner* — William Boddie
*Assistant Examiner* — Leonid Shapiro
(74) *Attorney, Agent, or Firm* — Michael Best & Friedrich LLP

(57) ABSTRACT

A self-luminous display panel driving method for driving a self-luminous display panel of the active matrix driving type, includes the step of executing threshold value correction operation for a driving transistor divisionally in a plurality of periods within at least one of which, after a point of time of an end of a preceding correction period till a point of time of a start of a succeeding correction period, a potential to be applied to the drain electrode of the driving transistor is controlled to an intermediate potential between a first potential for lighting driving of the driving transistor and a second potential for initialization applied within a preparation period of the first one of the correction periods.

10 Claims, 32 Drawing Sheets

FIG.14D1
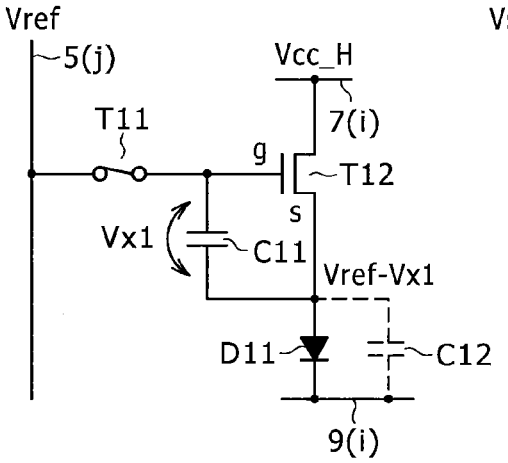
FIG.14D2
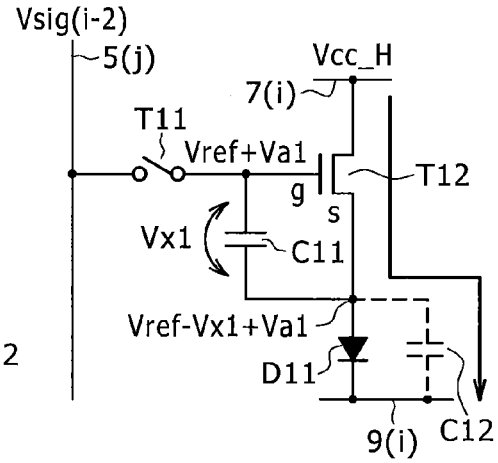
FIG.14D3
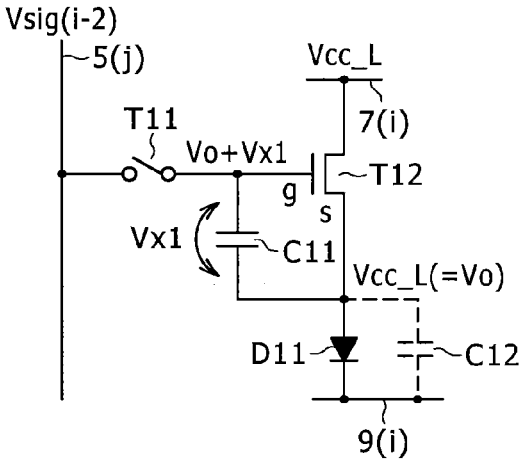
FIG.14D4
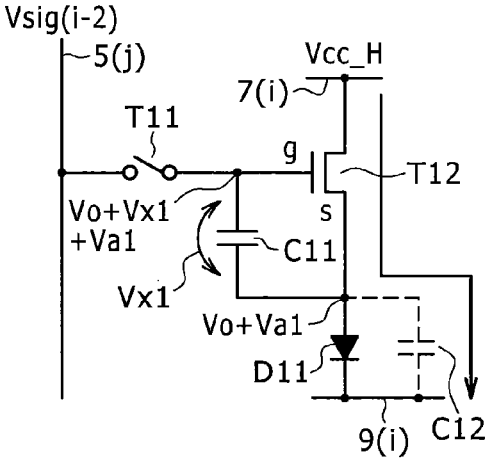
FIG.14D5
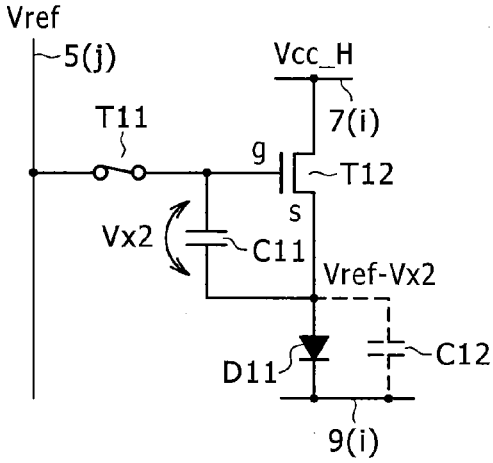

FIG.14D6
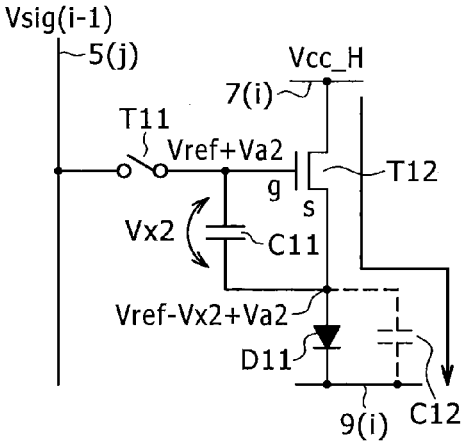
FIG.14D7
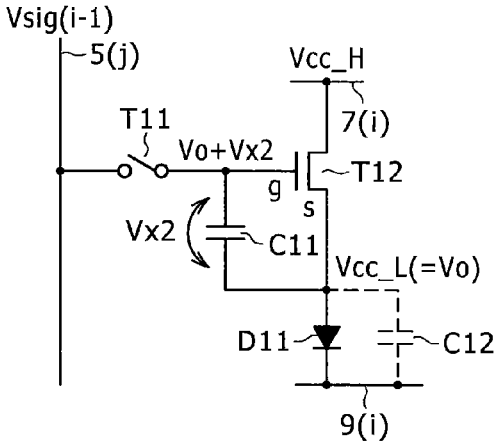
FIG.14D8
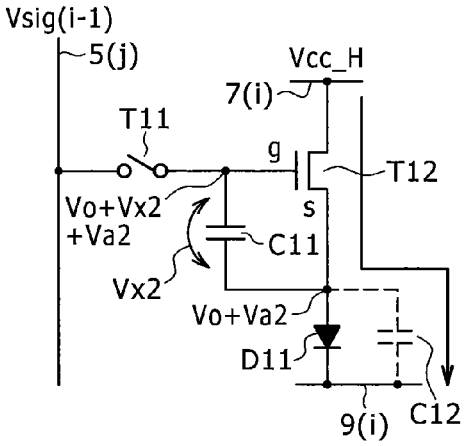
FIG.14D9
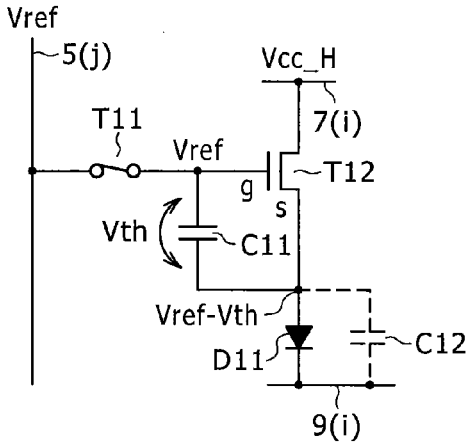

SELF-LUMINOUS DISPLAY PANEL DRIVING METHOD, SELF-LUMINOUS DISPLAY PANEL AND ELECTRONIC APPARATUS

CROSS REFERENCES TO RELATED APPLICATIONS

This is a Continuation application of the patent application Ser. No. 13/287,800, filed Nov. 2, 2011, which is a Continuation application of the patent application Ser. No. 12/078,798, filed Apr. 4, 2008, now U.S. Pat. No. 8,089,430, issued Jan. 3, 2012, which claims priority from Japanese Patent Application JP 2007-104590 filed with the Japan Patent Office on Apr. 12, 2007, the entire contents of which being incorporated herein by reference.

BACKGROUND OF THE INVENTION

1. Field of the Invention

This invention relates to a technique for driving a self-luminous display panel of the active matrix driving type.

More particularly, this invention relates to a self-luminous display panel driving method, a self-luminous display panel and an electronic apparatus of an active matrix driving type.

2. Description of the Related Art

An organic EL (Electro Luminescence) element has a characteristic called electroluminescence characteristic of re-emitting light in response to a voltage applied thereto. In recent years, a display device of the self-luminous type wherein such organic EL elements are disposed in a matrix has been and is proceeding.

A display panel which uses an organic EL element can be driven by an application voltage lower than 10 V. Therefore, the display panel of the type has a characteristic that the power consumption is low. Further, the display panel which uses an electronic EL element which is a self-luminous element has another characteristic that reduction in weight and reduction in film thickness are easy. In addition, the display panel which uses an organic EL element has a further characteristic that the response speed is as high as approximately several microseconds and an after image is less likely to appear upon display of moving pictures.

A passive matrix type driving system and an active matrix type driving system are available as a driving system for a display panel which uses an organic EL element. In recent years, development of a display panel of the active matrix type driving system wherein an active element such as a thin film transistor is disposed for each pixel is proceeding energetically.

A display panel of the active matrix type driving type is disclosed, for example, in Japanese Patent Laid-Open No. 2003-255856, No. 2003-271095, No. 2004-133240, No. 2004-029791, and No. 2004-093682.

SUMMARY OF THE INVENTION

Incidentally, in a display panel of the active matrix driving type, a fabrication dispersion in threshold voltage or mobility of driving transistors for driving organic EL elements may possibly be perceived as deterioration of the light emission luminance characteristic. Further, a secular change of the organic EL elements may possibly be perceived as deterioration of the light emission luminance characteristic.

Therefore, it is demanded to compensate for such characteristic variations as mentioned above to establish a technique of uniformizing the light emission luminance over the overall display screen image.

However, pixel circuits with a correction function having been proposed heretofore have a problem in that the structure is complicated. Further, the great number of components of pixel circuits makes an obstacle to improvement of the screen resolution.

Therefore, it is desirable to provide a self-luminous display panel driving technique by which enhancement of the accuracy in threshold value correction operation where a threshold value correction operation of a driving transistor is executed divisionally in a plurality of periods can be expected.

According to an embodiment of the present invention, there is provided a self-luminous display panel driving method for driving a self-luminous display panel of the active matrix driving type. The display panel driving method includes the step of executing threshold value correction operation for a driving transistor divisionally in a plurality of periods within at least one of which, after a point of time of an end of a preceding correction period till a point of time of a start of a succeeding correction period, a potential to be applied to the drain electrode of the driving transistor is controlled to an intermediate potential between a first potential for lighting driving of the driving transistor and a second potential for initialization applied within a preparation period of the first one of the correction periods.

According to another embodiment of the present invention, there is provided a self-luminous display panel driving method for driving a self-luminous display panel of the active matrix driving type. The display panel driving method includes the step of executing threshold value correction operation for a driving transistor divisionally in a plurality of periods within at least one of which, after a point of time of an end of a preceding correction period till a point of time of a start of a succeeding correction period, a potential to be applied to the drain electrode of the driving transistor is controlled to a second potential for initialization to be applied to a preparation period of the first one of correction periods.

When threshold value correction operation is not completed as yet, also within a suspension period of threshold value correction operation, the driving transistor exhibits an on state while it remains in a floating state. Therefore, the potential of the gate electrode within the suspension period changes together with a rise of the source electrode potential. In other words, bootstrap operation occurs.

However, by an influence of leak current and so forth, the hold voltage between the gate electrode and the source electrode of the driving transistor drops during the bootstrap operation. As the drop amount increases, the hold voltage between the gate electrode and the source electrode becomes lower than the threshold voltage in a shorter interval of time during the suspension of the threshold value correction operation. In other words, the probability that the threshold value correction operation may come to an end in error increases.

However, according to the driving methods of the embodiment of the present invention, the intermediate potential between the first potential for lighting driving of the driving transistor and the second potential for initialization applied within a preparation period of the first one of the correction periods or the second potential is applied to the drain electrode of the driving transistor within at least one of (including all) periods between correction periods within which the gate electrode of the driving transistor is placed in a floating state.

By the application of the intermediate potential or the second potential, the bootstrap operation is stopped compulsorily. In other words, the execution time of the bootstrap operation is reduced. Consequently, drop of the hold voltage between the gate electrode and the source electrode caused by the bootstrap operation is suppressed.

As a result, the difference between the hold voltage at the point of time of an end of a preceding correction period and the hold voltage at the point of time of a start of a succeeding correction period can be reduced. This signifies that, also where threshold value correction operation is executed divisionally in a plurality of periods, the continuity of the correction operations can be assured.

Consequently, the accuracy in the threshold value correction can be improved. As a result, in-plane uniformization of the luminance characteristic can be implemented, and the display quality can be improved.

BRIEF DESCRIPTION OF THE DRAWINGS

FIGS. 14A to 14C, 14D1 to 14D9, and 14F to 14H are circuit diagrams illustrating operation states of the pixel circuit within different periods illustrated in FIG. 13;

DETAILED DESCRIPTION OF THE PREFERRED EMBODIMENT

In the following, an organic EL panel of the active matrix driving type to which the present embodiment is described.

It is to be noted that, to those matters which are not disclosed in the present specification or the accompanying drawings, technical matters already known in the technical field to which the present invention belongs are applied.

(A) Basic Circuit and Basic Operation

(A-1) Example of Pixel Circuit

Figure 1:
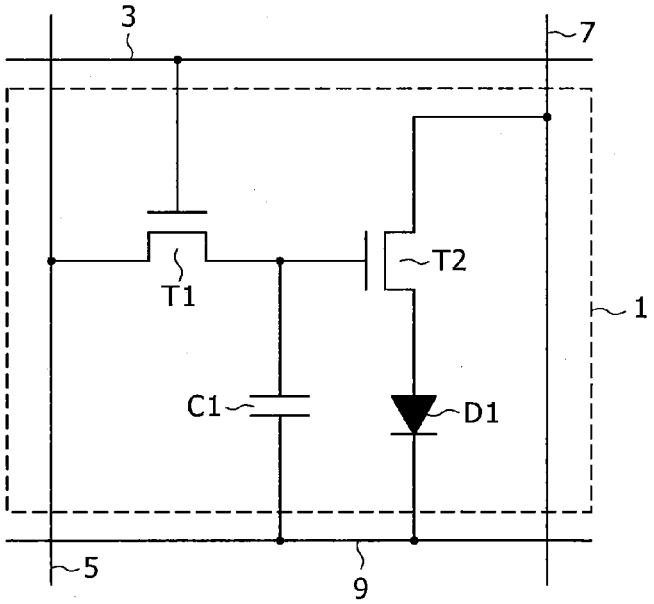
FIG. 1 is a circuit diagram showing an example of a pixel circuit used to form an organic EL panel of the active matrix driving type.

FIG. 1 shows a structure of a popular used in an organic EL panel of the active matrix driving type. Referring to FIG. 1, the pixel circuit 1 shown is disposed at each of intersecting points of scanning lines 3 and signal lines 5 disposed perpendicularly each other.

A sampling transistor T1 is disposed at an intersecting point between a scanning line 3 and a signal line 5 shown in FIG. 1. In the present example, the sampling transistor T1 is a thin film transistor of the N-channel type. The sampling transistor T1 is connected at the gate thereof to the scanning line 3 and at the drain electrode of the signal line 5.

To the source electrode of the sampling transistor T1, one of electrodes of a hold capacitor C1 and the gate electrode of a driving transistor T2 are connected. In the example shown, also the driving transistor T2 is a thin film transistor of the N-channel type.

A power supply line 7 is connected to the drain electrode of the driving transistor T2, and an organic EL element D1 is connected at the positive electrode thereof to the source electrode of the driving transistor T2. The other electrode of the hold capacitor C1 and the negative electrode of the organic EL element D1 are connected to a ground line 9.

(A-2) Basic Operation

Figure 2:
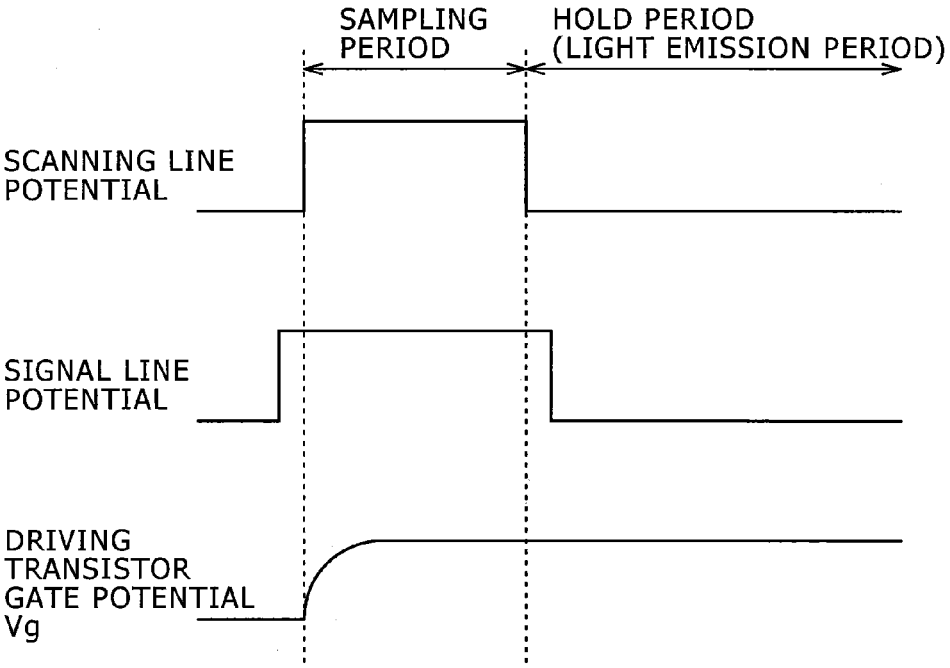
FIG. 2 is a timing chart illustrating an example of driving signals of the display circuit.

FIG. 2 illustrates basic driving operation of the pixel circuit 1. In particular, FIG. 2 illustrates sampling operation of the sampling transistor T1. Sampling of the potential of the signal line 5, that is, of the signal line potential, is executed within a period within which the potential of the scanning line 3, that is, the scanning line potential, has the high level. Thereupon, the sampling transistor T1 exhibits an on state and charges the hold capacitor C1 with the signal line potential of the high potential. In other words, the signal line potential is written into the hold capacitor C1.

By such writing of the signal line potential, the gate potential Vg of the driving transistor T2 starts its rise, and supply of drain current to the organic EL element D1 is started. In response to this, the organic EL element D1 starts emission of light. Incidentally, the light emission luminance after the potential of the scanning line 3 changes to the low level depends upon the signal line potential held by the hold capacitor C1. This light emission luminance is kept till a next frame.

(A-3) Influence of the Characteristic Dispersion

As described above, the threshold voltage or the mobility of the driving transistor T2 varies depending upon the dispersion in fabrication process. If the driving transistor T2 has a dispersion in such characteristics, then even if the same gate potential is applied to the driving transistor T2, drain current or driving current of the equal magnitude cannot be supplied. In other words, a dispersion appears with the light emission luminance.

Also the anode potential varies in response to a chronological characteristic variation of the organic EL element D1. This variation of the anode potential acts as a variation of the holding voltage held between the gate electrode and the source electrode of the driving transistor T2. As a result, the drain current or driving current varies.

Thus, appearing a characteristic dispersion as a luminance characteristic makes an image quality deteriorate.

Figure 3:
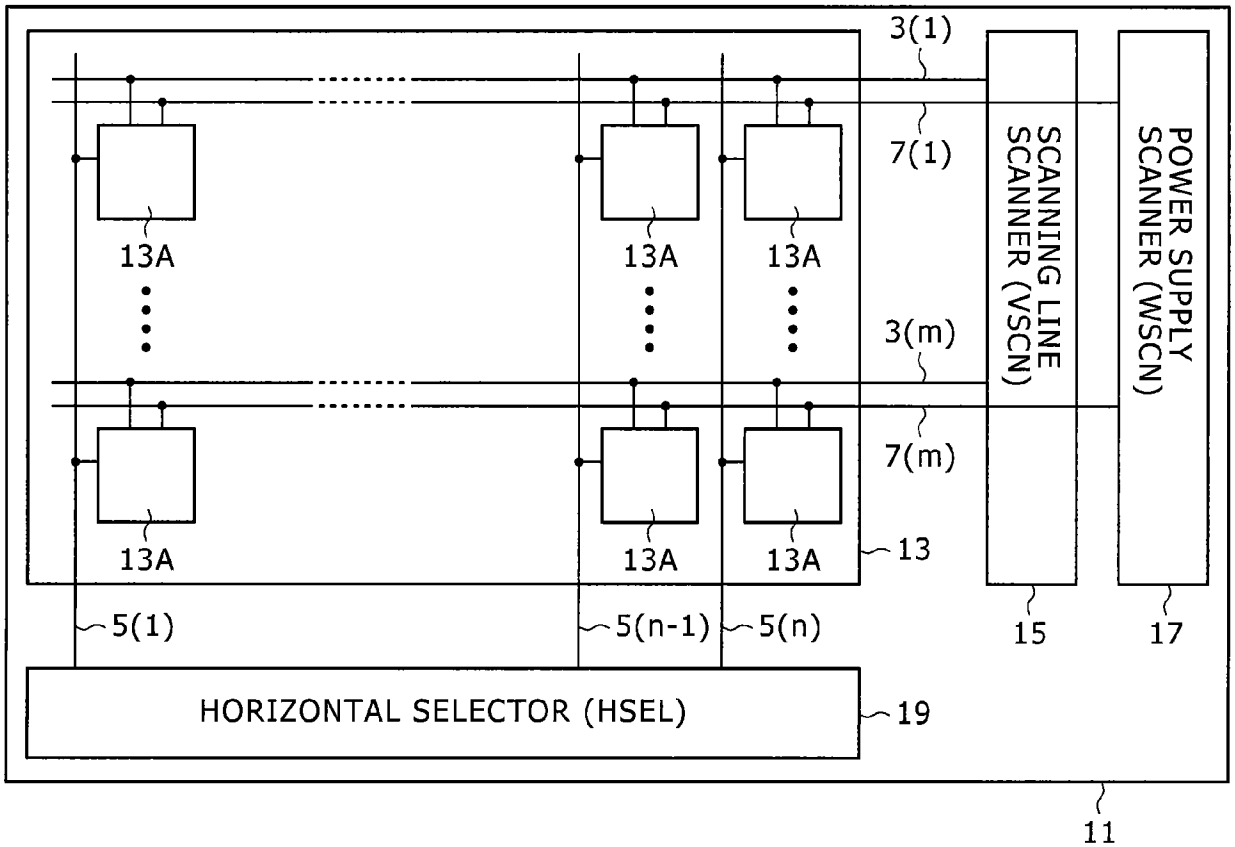
FIG. 3 is a block diagram showing a functional structure of an organic EL panel of the active matrix driving type.

(B) Driving Operation with a Correction Function of a Characteristic Dispersion (B-1) Panel Structure FIG. 3 shows an example of a structure of an organic EL panel of the active matrix driving type. Referring to FIG. 3, the organic EL panel 11 shown includes a pixel array section 13, and driving circuits 15, 17 and 19 for driving the pixel array section 13.

The pixel array section 13 includes m rows of scanning lines 3(1) to 3(*m*), n columns of signal lines 5(1) to 5(*n*), and m rows of power supply lines 7(1) to 7(*m*), and pixel circuits 13A individually disposed at intersecting points between the scanning lines 3(1) to 3(*m*) and power supply lines 7(1) to 7(*m*) and the signal lines 5(1) to 5(*n*).

The driving circuit includes a scanning line scanner 15, a power supply scanner 17 and a horizontal selector 19. The scanning line scanner 15 line-sequentially supplies a control signal to the sampling transistors T1 connected to the scanning lines 3(1) to 3(*m*). By the line-sequential scanning, the operation state of the sampling transistors T1 is controlled in a unit of a row.

The power supply scanner 17 line-sequentially supplies a power supply voltage to the driving transistors T2 connected to the power supply lines 7(1) to 7(*m*). By the line-sequential scanning, the operation condition of the driving transistors T2 is controlled in a unit of a row. To the power supply lines 7(1) to 7(*m*), one of a first potential of a high level for lighting driving and a second potential of a low level for initialization is selectively applied.

The horizontal selector 19 supplies a signal potential or a reference potential for threshold value correction, that is, an initialization potential to the signal lines 5(1) to 5(*n*) in response to an image signal. The supply of the signal potential or the reference potential or initialization potential is executed in a unit of a horizontal scanning period.

Figure 4:
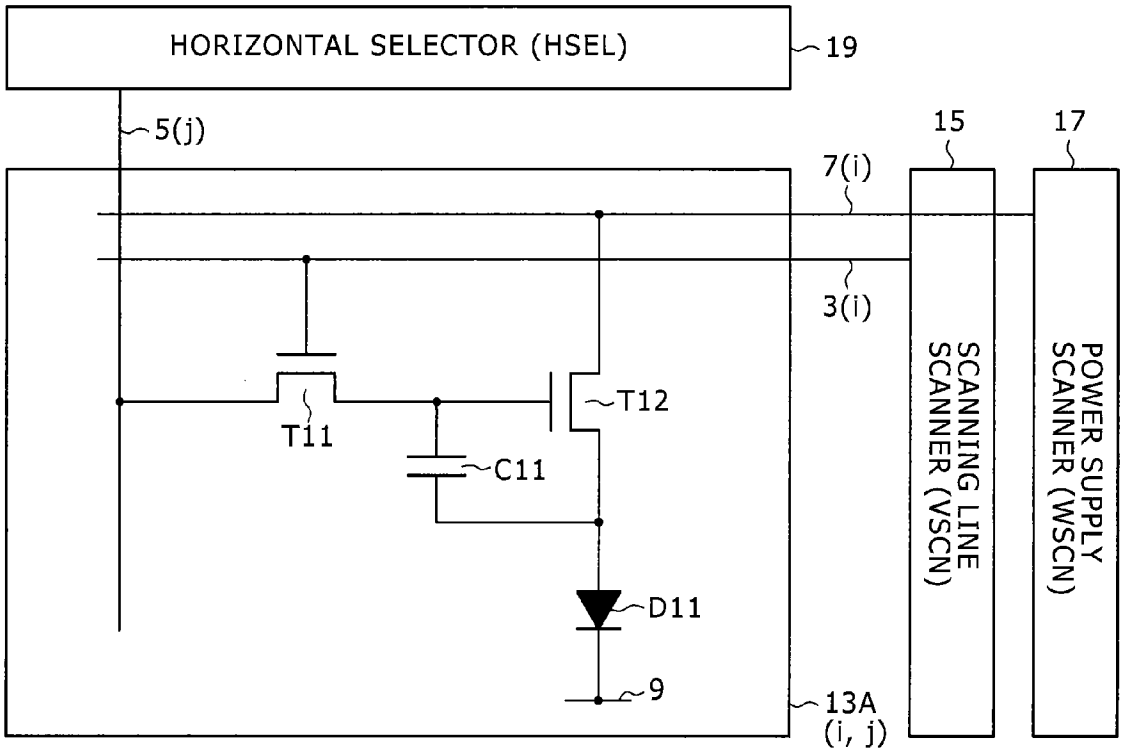
FIG. 4 is a block diagram illustrating a connection relationship of a display circuit and driving circuits.

FIG. 4 illustrates a connection relationship of a pixel circuit 13A and the driving circuits 15, 17 and 19. Incidentally, FIG. 4 illustrates a connection relationship of a pixel circuit 13A positioned on the ith row and jth column. The pixel circuit 13A includes a sampling transistor T11, a driving transistor T12, a hold capacitor C11 and an organic EL element D11.

Also in the pixel circuit 13A, the sampling transistor T11 is a thin film transistor of the N-channel type. Accordingly, the sampling transistor T11 is connected at the gate thereof to the scanning line 3(*i*), at the drain electrode thereof to the signal line 5(*j*) and at the source electrode thereof to one of electrodes of the hold capacitor C11 and the gate electrode of the driving transistor T2.

Also in the case of the present example, the driving transistor T12 is a thin film transistor of the N-channel type. Accordingly, the driving transistor T12 is connected at the drain thereof to the power supply line 7(*i*) and at the source electrode thereof to the positive electrode of the organic EL element D11 and the other electrode of the hold capacitor C11.

In particular, the hold capacitor C11 is connected between the gate electrode and the source electrode of the driving transistor T12.

The cathode electrode of the organic EL element D11 is connected to the ground line 9 common to all pixels.

(B-2) Driving Operation

Timing Chart

Figure 5:
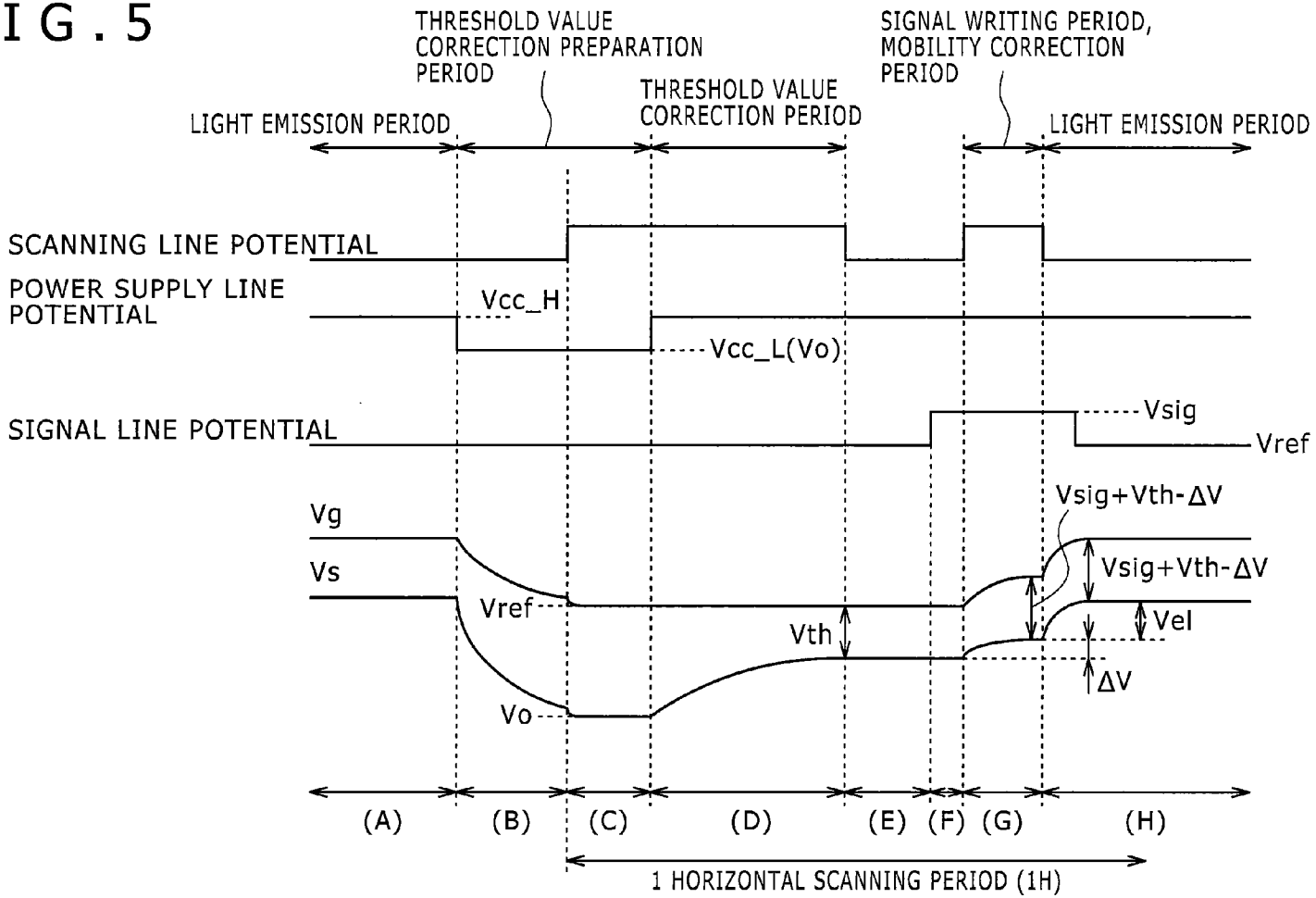
FIG. 5 is a timing chart illustrating driving signals where the organic EL panel of the active matrix driving type has a characteristic dispersion correction function.

FIG. 5 illustrates basic driving operation demanded in correction of the characteristic dispersion which the pixel circuit 13A has. In the example of operation illustrated in FIG. 5, threshold value correction operation and mobility correction operation of the driving transistor T12 are executed within one horizontal scanning period (1H).

It is to be noted that FIG. 5 illustrates potential variations of the scanning line 3(*i*), signal line 5(*j*) and power supply line 7(*i*) on the common time axis. Also the variation of the gate potential Vg and the variation of the source potential Vs of the driving transistor T12 are illustrated. Further, FIG. 5 illustrates the potential variations divisionally in eight periods (A) to (H) for the convenience of illustration.

(i) Light Emission Period

Within the period (A), the organic EL element D11 is in a light emitting state. After this period, a new field of line sequential scanning is started.

(ii) Threshold Correction Preparation Period

After the new field is started, preparations for threshold value correction are executed over the periods (B) and (C). Incidentally, within the period (B), the supply of drain current to the organic EL element D11 is stopped. As a result, the light emission of the organic EL element D11 stops. At this time, the light emission voltage Vel of the organic EL element D11 varies so as to approach zero.

As the light emission voltage Vel drops in this manner, the source potential Vs of the driving transistor T12 varies to a potential substantially equal to a second potential Vo for initialization. Obviously, the gate potential Vg of the driving transistor T12 also drops. It is to be noted that the gate potential Vg of the driving transistor T12 is initialized to a reference voltage Vref which is applied to the driving transistor T12 through the signal line 5(*j*) within the succeeding period (C).

As a result of execution of the two initialization operations, the initialization of the holding voltage of the hold capacitor C11 is completed. In particular, the holding voltage of the hold capacitor C11 is initialized to the voltage (Vref−Vo) higher than the threshold voltage Vth of the driving transistor T12. This is preparation operation for threshold value correction.

(iii) Threshold Value Correction Operation

Thereafter, threshold value correction operation is started in the period (D). Also within this period (D), the reference voltage Vref is applied as the gate potential Vg. In this state, the first potential of the high level for lighting driving is applied to the power supply line potential. Thereupon, the cathode potential is controlled to the high level through the common line 9 so that drain current may not flow to the organic EL element D11.

As a result, drain current flows to the signal line 5(*j*) through the hold capacitor C11, and the hold voltage Vgs of the hold capacitor C11 decreases. As a result, the source potential Vs of the driving transistor T12 rises.

It is to be noted that the drop of the hold voltage Vgs of the hold capacitor C11 stops at a point of time when the hold voltage Vgs reaches the threshold voltage Vth and the driving transistor T12 cuts off. Thus, the threshold value correction operation of setting the hold voltage Vgs of the hold capacitor C11 to the threshold voltage Vth unique to the driving transistor T12 is completed.

(iv) Preparation Operation for Writhing of a Signal Potential and Correction of the Mobility After the threshold value correction operation is completed, preparation operation for writing of a signal potential and mobility correction is executed over the periods (E) and (F). However, the periods (E) and (F) may be omitted. Incidentally, within the period (E), the scanning line potential is changed over to the low level to control the driving transistor T12 to a floating state.

Further, within the period (F), a signal potential Vsig corresponding to an image signal is applied to the signal line 5(*j*). The period (F) is disposed taking a delay of a rising edge of the signal line potential by an influence of a capacitance component parasitic in the signal line 5(*j*) into consideration. By the presence of this period, within the next period (G), writing can be started in a state wherein the signal line potential is stabilized.

(v) Writing of a Signal Potential and Correction Operation of the Mobility

Within the period (G), writing of a signal potential and correction operation of the mobility are executed. In particular, the scanning line potential is changed over to a high level, and the signal potential Vsig is applied to the gate potential of the driving transistor T12. As a result of the application of the signal potential Vsig, the hold voltage Vgs held in the hold capacitor C11 changes to Vsig+Vth. Since the hold voltage Vgs becomes higher than the threshold voltage Vth, the driving transistor T12 is changed over to an on state.

After the driving transistor T12 is changed over to an on state, drain current begins to flow through the organic EL element D11. However, at a stage at which the drain current begins to flow, the organic EL element D11 still remains in a cutoff state, that is, in a high-impedance state. Therefore, the drain current flows to charge the parasitic capacitance of the organic EL element D11.

The anode potential of the organic EL element D11, that is, the source potential Vs of the driving transistor T12, rises by the charge potential ΔV of the parasitic capacitance. The hold voltage Vgs of the hold capacitor C11 drops by the charge voltage ΔV. In particular, the hold voltage Vgs changes to Vsig+Vth−ΔV. In this manner, the operation by which the hold voltage Vgs is corrected by the charge potential ΔV of the parasitic capacitance C12 corresponds to correction operation of the mobility.

It is to be noted that, by bootstrap operation of the hold capacitor C11, the gate potential Vg of the driving transistor T12 rises by an amount equal to the rise amount of the source potential Vs.

(vi) Light Emission Period

Within the period (H), the scanning line potential is changed to the low level, and the gate electrode of the driving transistor T12 is placed into a floating state. The driving transistor T12 supplies drain current corresponding to the holding voltage Vgs (=Vsig+Vth−ΔV) after the mobility correction to the organic EL element D11.

Consequently, the organic EL element D11 starts emission of light. Thereupon, the anode potential of the organic EL element D11, that is, the source potential Vs of the driving transistor T12, rises to the light emission voltage Vel corresponding to the magnitude of the drain current.

At this time, by bootstrap operation of the hold capacitor C11, the gate potential Vg of the driving transistor T12 rises to the light emission voltage Vel.

(B-2) Variation of the Connection State and the Potential in the Pixel Circuit Here, a variation of the connection state and the potential of the pixel circuit 13A corresponding to the periods of FIG. 5 is described. Here, reference symbols same as those applied to the corresponding periods are applied to different figures. In particular, FIGS. 6A to 6H illustrate operation states within the periods (A) to (H) in FIG. 5, respectively. It is to be noted that, in FIGS. 6A to 6H, the sampling transistor T11 is represented as a switch and the parasitic capacitance of the organic EL element D11 is represented explicitly as C12.

(i) Light Emission Period

Figure 6A:
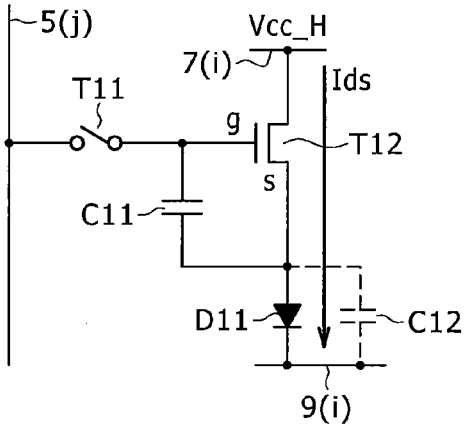
FIGS. 6A to 6H are circuit diagrams illustrating operation states of a pixel circuit shown in FIG. 4 within different periods illustrated in FIG. 5.

FIG. 6A corresponds to the operation condition within the period (A) of FIG. 5. Within the period (A) as a light emission period, a first potential Vcc_H for lighting driving is applied to the power supply line 7(*i*). At this time, the driving transistor T12 supplies drain current Ids corresponding to the hold voltage Vgs (>Vth) of the hold capacitor C11 to the organic EL element D11. The light emission period of the organic EL element D11 continues till the end of the period (A).

(ii) Threshold Value Preparation Period

Figure 6B:
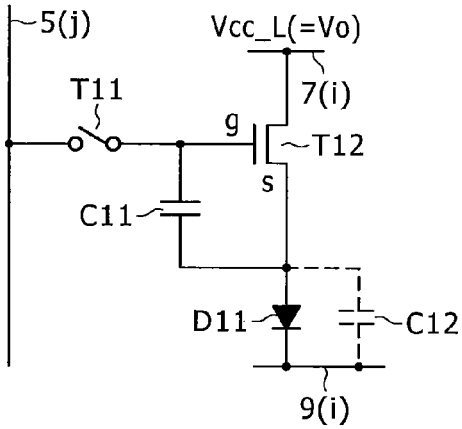

FIG. 6B corresponds to the operation state of the period (B) of FIG. 5. Within the period (B), the potential of the power supply line 7(*i*) is changed over from the first potential Vcc_H for lighting driving to a second potential Vcc_L for initialization, that is, the second potential Vo for initialization. By the changeover, the supply of the drain current Ids is interrupted.

As a result, the gate potential Vg and the source potential Vs of the driving transistor T12 drop in an interlocking relationship with the drop of the light emission voltage Vel of the organic EL element D11. Then, the source potential Vs drops to a potential substantially equal to the second potential Vo applied to the power supply line 7(*i*). It is to be noted that the second potential Vo is sufficiently lower than the reference voltage Vref for initialization applied to the signal line 5(*j*).

Figure 6C:
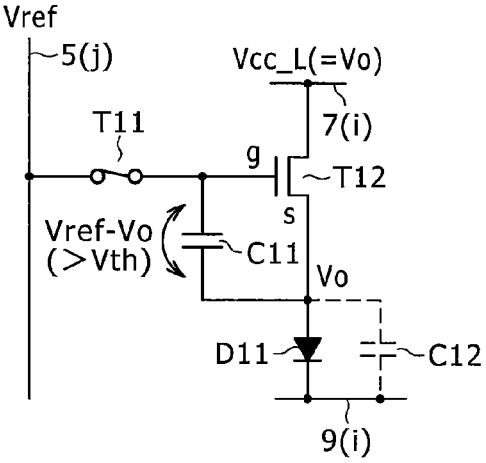

FIG. 6C corresponds to the operation state within the period (C) of FIG. 5. Within the period (C), the potential of the scanning line 3(*i*) changes to the high level. Consequently, the sampling transistor T11 is controlled to an on state, and the gate potential Vg of the driving transistor T12 is set to the reference voltage Vref for initialization applied to the signal line 5(*j*).

After the period (C) comes to an end, the hold voltage Vgs of the hold capacitor C11 is initialized to a voltage higher than the threshold voltage Vth of the driving transistor T12. As a result, the driving transistor T12 is placed into an on state. It is to be noted that, if the drain current Ids is supplied to the organic EL element D11 at this point of time, then light independent of the signal potential Vsig is emitted.

Therefore, the organic EL element D11 is biased reversely by the high potential applied to the ground line 9. Accordingly, the drain current Ids flows to the signal line 5(*j*) through the hold capacitor C11 and the sampling transistor T11.

(iii) Threshold Value Correction Operation

Figure 6D:
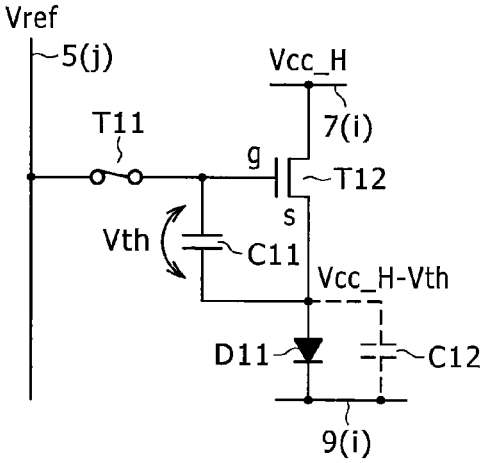

FIG. 6D corresponds to the operation state of the period (D) of FIG. 5. Within the period (D), the potential of the power supply line 7(*i*) changes from the second potential Vcc_L for initialization, that is, from the second potential Vo for initialization, to the first potential Vcc_H for lighting driving. It is to be noted that the sampling transistor T11 is kept in an on state.

As a result, only the source potential Vs starts its rising while the reference voltage Vref for initialization of the gate potential Vg of the driving transistor T12 remains equal to the reference voltage Vref for initialization. At a point of time within a period till the end of the period (D), the hold voltage Vgs of the hold capacitor C11 becomes equal to the threshold voltage Vth. Consequently, the driving transistor T12 is placed into an off state. The source potential Vs at this point of time becomes lower by the threshold voltage Vth than the gate potential Vg (=Vref).

Figure 6E:
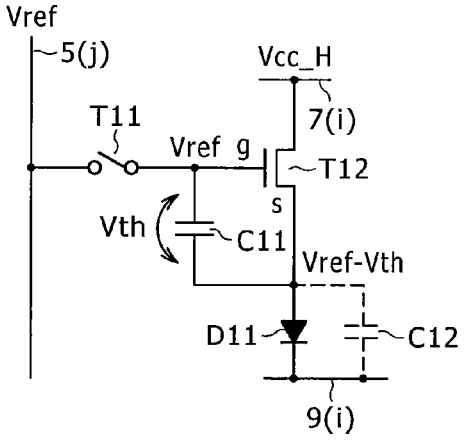

(iv) Preparation Operation for Writing of a Signal Potential and Correction of the Mobility FIG. 6E corresponds to the operation state within the period (E) of FIG. 5. Within the period (E), the potential of the scanning line 3(*i*) changes to the low level. As a result, the sampling transistor T11 is controlled to an off state and the gate electrode of the driving transistor T12 is placed into a floating state.

However, the cutoff state of the driving transistor T12 is maintained. Accordingly, the drain current Ids does not flow.

Figure 6F:
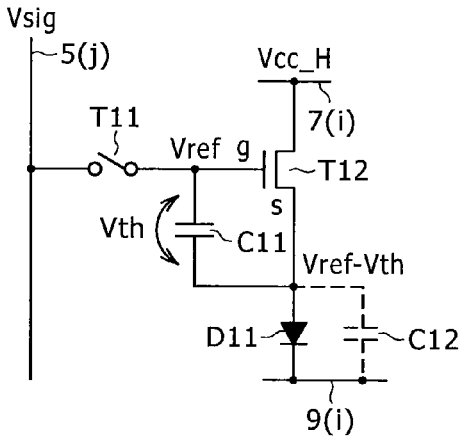

FIG. 6F corresponds to the operation state within the period (F) of FIG. 5. Within the period (F), the potential of the signal line 5(*j*) changes from the reference voltage Vref for initialization to the signal potential Vsig. Meanwhile, the sampling transistor T11 remains in the off state.

(v) Writing of a Signal Potential and Correction Operation of the Mobility

Figure 6G:
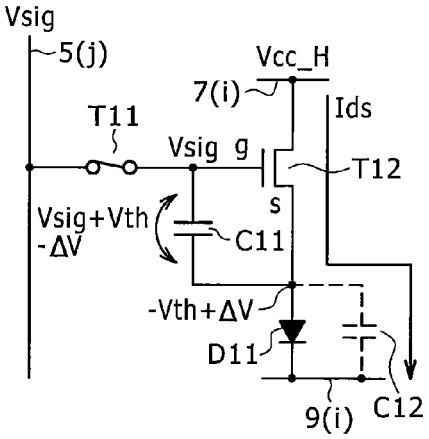

FIG. 6G corresponds to the operation state within the period (G) of FIG. 5. Within the period (G), the potential of the scanning line 3(*i*) changes to the high level. Consequently, the sampling transistor T11 is controlled to an on state and the gate potential of the driving transistor T12 changes to the signal potential Vsig.

Further, within the period (G), the potential of the power supply line 7(*i*) changes to the first potential Vcc_H for lighting driving. As a result, the driving transistor T12 is placed into an on state and the drain current Ids begins to flow. However, the organic EL element D11 is in a cutoff state or high impedance state first. Therefore, the drain current Ids flows not into the organic EL element D11 but into the parasitic capacitance C12 as seen in FIG. 6G.

The source potential Vs of the driving transistor T12 begins to rise in response to charging of the parasitic capacitance C12. The hold voltage Vgs of the hold capacitor C11 soon becomes equal to Vsig+Vth−ΔV. In this manner, sampling of the signal potential Vsig and correction by the charge voltage ΔV are executed in parallel. It is to be noted that, as the signal potential Vsig increases, also the drain current Ids increases and also the absolute value of the charge potential ΔV increases.

Consequently, mobility correction according to the light emission luminance level can be carried out. It is to be noted that, where the signal potential Vsig is fixed, as the mobility μ of the driving transistor T12 increases, also the absolute value of the charge potential ΔV increases. This arises from the fact that, as the mobility μ increases, the negative feedback amount increases.

(v) Writing of a Signal Potential and Correction Operation of the Mobility

Figure 6H:
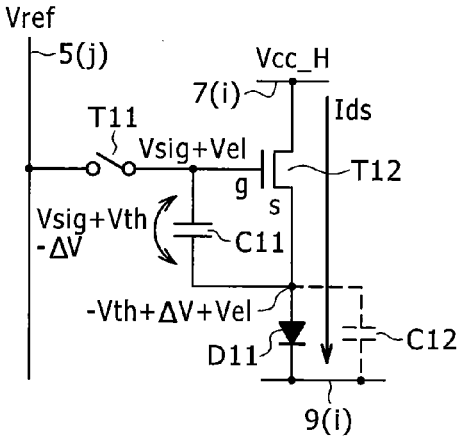

FIG. 6H corresponds to the operation state within the period (H) of FIG. 5. Within the period (H), the potential of the scanning line 3(*i*) changes to the low level again. Consequently, the sampling transistor T11 is controlled to an off state and the gate electrode of the driving transistor T12 is placed into a floating state.

It is to be noted that, since the potential of the power supply line 7(*i*) is maintained at the first potential Vcc_H for lighting control, drain current Ids corresponding to the hold voltage Vgs (=Vsig+Vth−ΔV) of the hold capacitor C11 is continuously supplied to the organic EL element D11. As a result of the supply of the drain current, the organic EL element D11 begins to emit light. Simultaneously, a light emission voltage Vel corresponding to the magnitude of the drain current Ids is generated between the electrodes of the organic EL element D11.

In particular, the source potential Vs of the driving transistor T12 rises. Further, by bootstrap operation of the hold capacitor C11, the gate potential Vg rises by an amount equal to the rise amount of the source potential Vs. In the hold capacitor C11, the holding voltage Vgs (=Vsig+Vth−ΔV) equal to that prior to the bootstrap operation is held. As a result, the light emitting operation by the drain current Ids after mobility correction is continued.

(B-3) Correction Effects

Here, effects of correction are confirmed.

Figure 7:
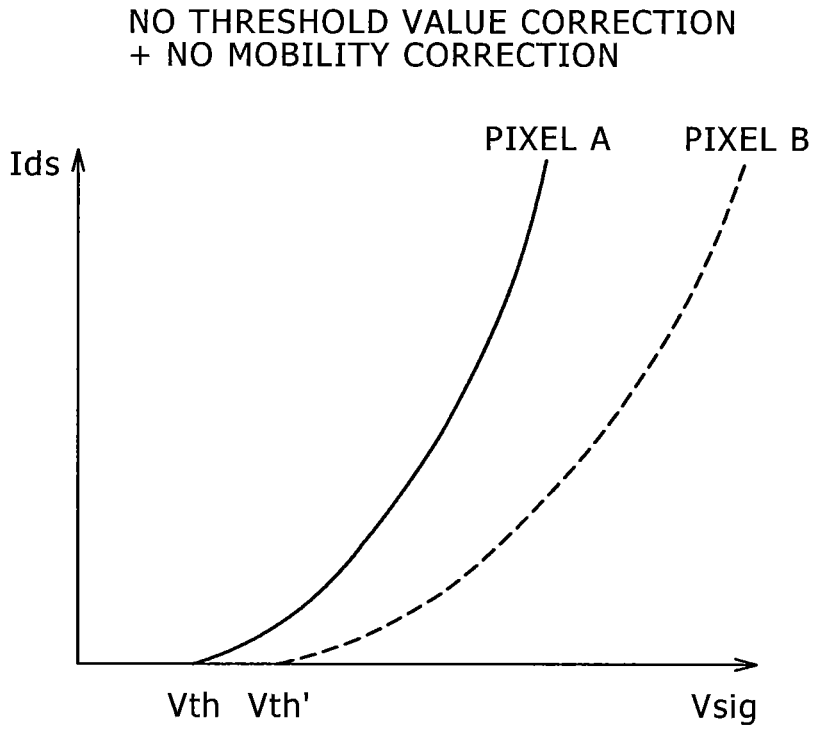
FIG. 7 is a diagram illustrating a current-voltage characteristic of driving transistors having a characteristic dispersion.

FIG. 7 illustrates a current-voltage characteristic of the driving transistor T12. Particularly, the drain current Ids when the driving transistor T12 is operating within a saturation region is represented by the following expression (1)]:

$$Ids=(1/2)\cdot\mu\cdot(W/L)\cdot Cox\cdot(Vgs-Vth)^2 \quad (1)$$

where μ is the mobility, W the gate width, L the gate length, and Cox the gate oxide film capacitance per unit area.

As can be seen apparently from the transistor characteristic expression (1) above, as the threshold voltage Vth varies, the drain current Ids varies even if the hold voltage Vgs is fixed. FIG. 7 illustrates a relationship between the signal potential Vsig and the drain current Ids where none of threshold value correction and mobility correction is executed.

However, in the correction operation example described hereinabove, the hold voltage Vgs upon light emission is given by Vsig+Vth−ΔV. Accordingly, the expression (1) can be represented in the following manner:

$$Ids=(1/2)\cdot\mu\cdot(W/L)\cdot Cox\cdot(Vsig-\Delta V)^2 \quad (2)$$

From the expression (2), the threshold voltage Vth disappears. In other words, it can be recognized that the drain current Ids does not rely upon the threshold voltage Vth as a result of the correction operation described above.

Figure 8:
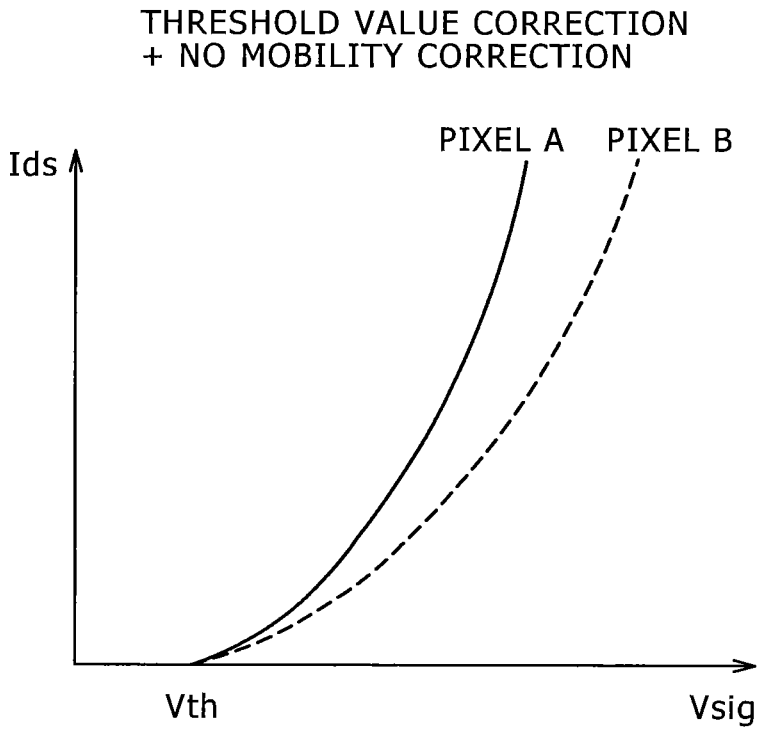
FIG. 8 is a similar view but illustrating a current-voltage characteristic of driving transistors after threshold value correction is carried out therefor.

This signifies that, even if some dispersion exists in the threshold voltage Vth of the driving transistor T12 which composes the pixel circuit 13A, the influence of the dispersion does not appear in the drain current Ids. FIG. 8 illustrates a relationship between the signal potential Vsig and the drain current Ids where only the threshold value correction is executed.

However, between pixels which are different in the mobility μ, even if the signal potential Vsig is equal, the drain current Ids exhibits different values. In the case of FIG. 8, the mobility μ is higher with the pixel A than with the pixel B. Therefore, even where the signal potential Vsig is equal, the drain current Ids of the pixel A is higher than the drain current Ids of the pixel B. However, the charge voltage ΔV generated in the parasitic capacitance C12 within the same correction period relies upon the mobility μ.

Figure 9:
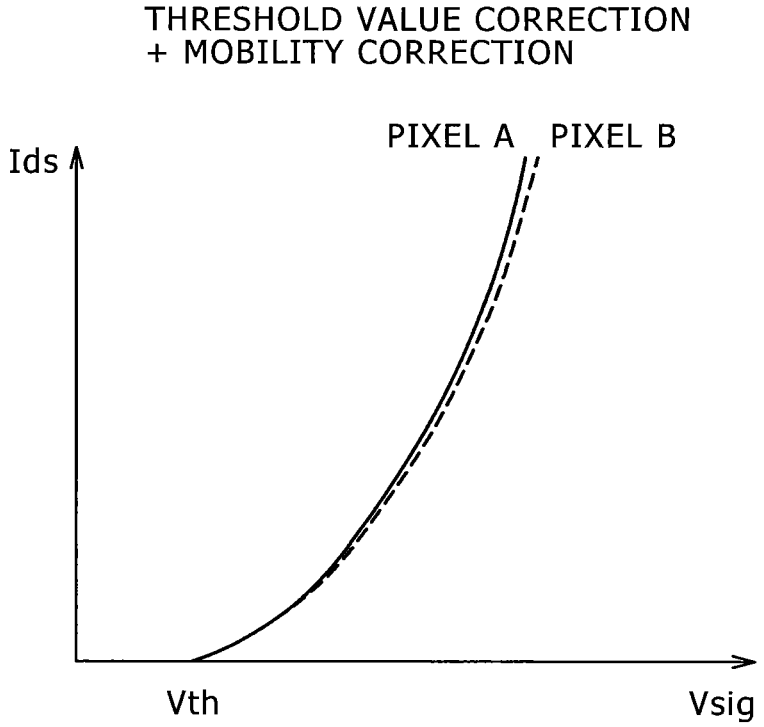
FIG. 9 is a similar view but illustrating a current-voltage characteristic of driving transistors after threshold value correction and mobility correction are carried out therefor.

In particular, the charge voltage ΔV of a pixel having a higher mobility μ is higher than that of another pixel having a lower mobility μ. In the expression (2), the charge potential ΔV acts in a direction in which the drain current Ids decreases. As a result, the influence of the dispersion of the mobility μ appearing with the drain current Ids is suppressed. As a result, equal drain current Ids flows whatever magnitude the signal potential Vsig has as seen in FIG. 9.

(C) Example of Division of the Threshold Value Correction Operation

(C-1) Background of and Subject in Execution of Division

As described hereinabove, a high quality display characteristic free from a luminance dispersion can be implemented by executing threshold value correction operation and mobility correction operation individually by once within one horizontal period.

However, driving conditions demanded for organic EL panels in recent years have become severe, and the time which can be allocated to one horizontal scanning period has become very short.

One of factors which decrease one horizontal scanning period is to cope with employment of a higher clock frequency by employment of a higher definition. Another one of the factors is to cope with a half frame rate. A further one of the factors is to cope with a vertically elongated screen as is used in a portable telephone set or a portable digital assistant.

Actually, if the threshold value correction period which can be allocated within one horizontal scanning period decreases, then there is the possibility that the threshold value correction operation for all pixels may not be completed within the allocated time period. Naturally, if the threshold value correction is insufficient or inaccurate, then a luminance dispersion occurs.

Figure 10:
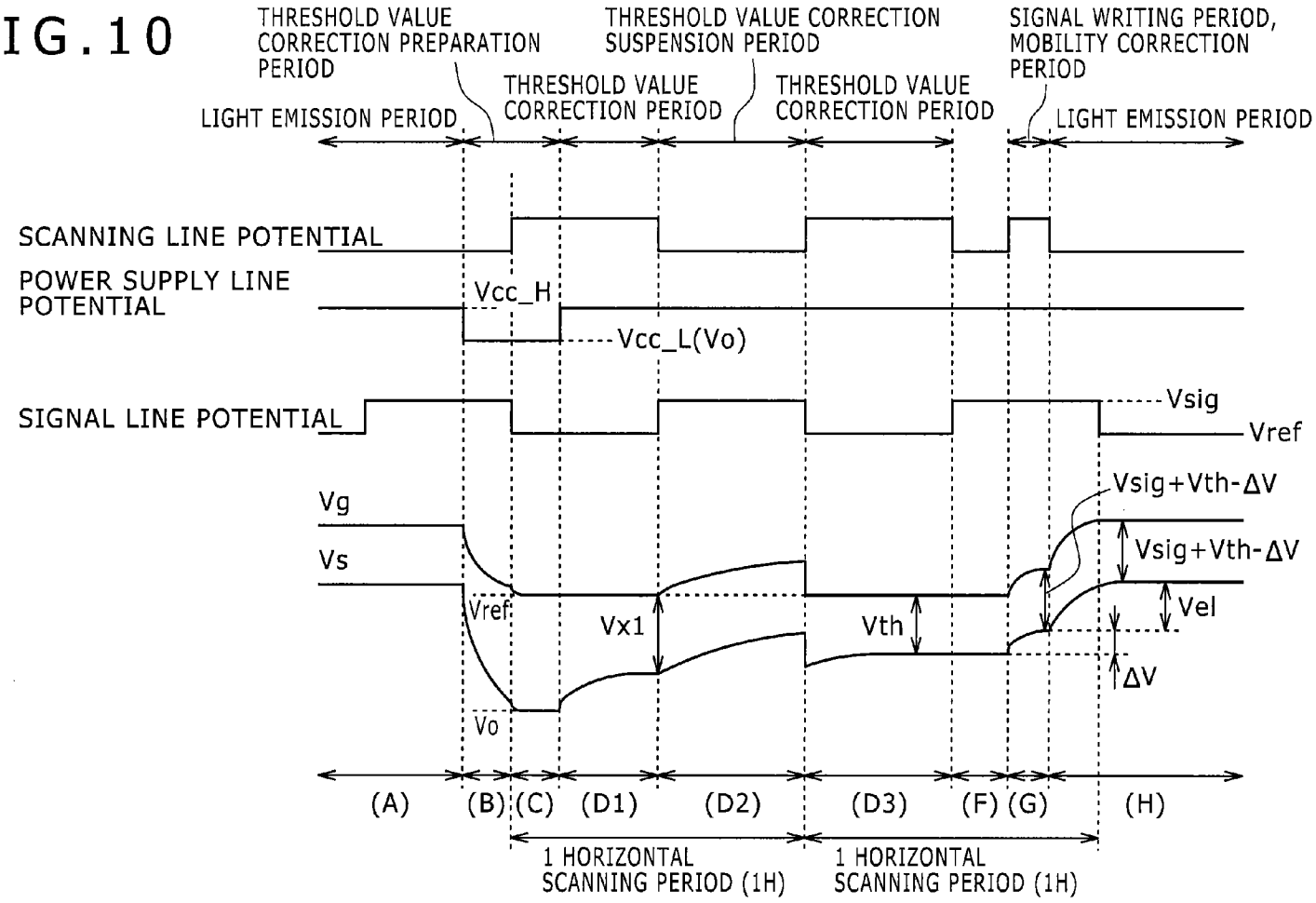
FIG. 10 is a timing chart illustrating an example of driving signals where threshold value correction is carried out with a threshold value correction period divided into two correction periods.

Therefore, it is investigated here to divide a threshold value correction period into two correction periods and one correction suspension period as seen in FIG. 10 and the threshold value correction is executed dispersedly within the two horizontal scanning periods. Alternatively, it is investigated here to divide a threshold value correction period into three correction periods and two correction suspension period as seen in FIG. 11 and the threshold value correction is executed dispersedly within the three horizontal scanning periods.

Figure 11:
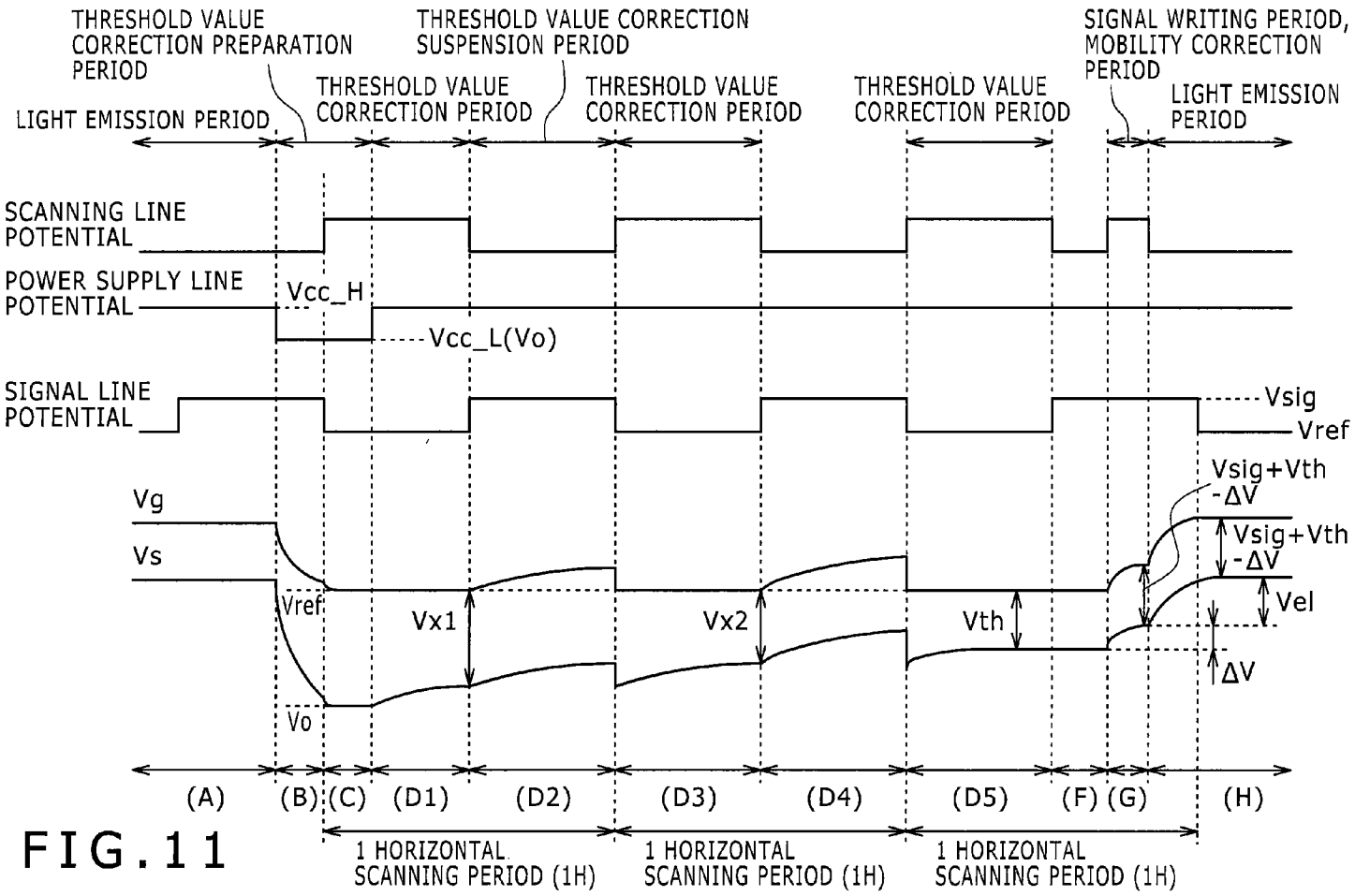
FIG. 11 is a timing chart illustrating an example of driving signals where threshold value correction is carried out with a threshold value correction period divided into three correction periods.

Incidentally, in FIGS. 10 and 11, like reference symbols are applied to those periods which correspond to the periods illustrated in FIG. 5. Incidentally, only to the period (D) corresponding to the threshold value correction period, serial numbers are applied to the individual sub periods.

Even if one horizontal scanning period is short, if the threshold value correction operation is executed by a plural number of times as seen in FIGS. 10 and 11, then a generally sufficient correction period can be assured.

It is to be noted that, since one horizontal scanning period is originally short, the hold voltage Vgs at the point of time at which the threshold value correction is temporarily suspended is in a state wherein it is higher than the threshold voltage Vth of the driving transistor T12. Accordingly, also within the suspension period of the threshold value correction, the driving transistor T12 is in an on state.

If, in this state, the gate electrode of the driving transistor T12 is controlled to a floating state as seen in FIGS. 10 and 11, then the drain current Ids flows into the parasitic capacitance C12 to raise the source potential Vs. Naturally, also the gate potential Vg which is in a floating state rises by bootstrap operation.

Figure 12:
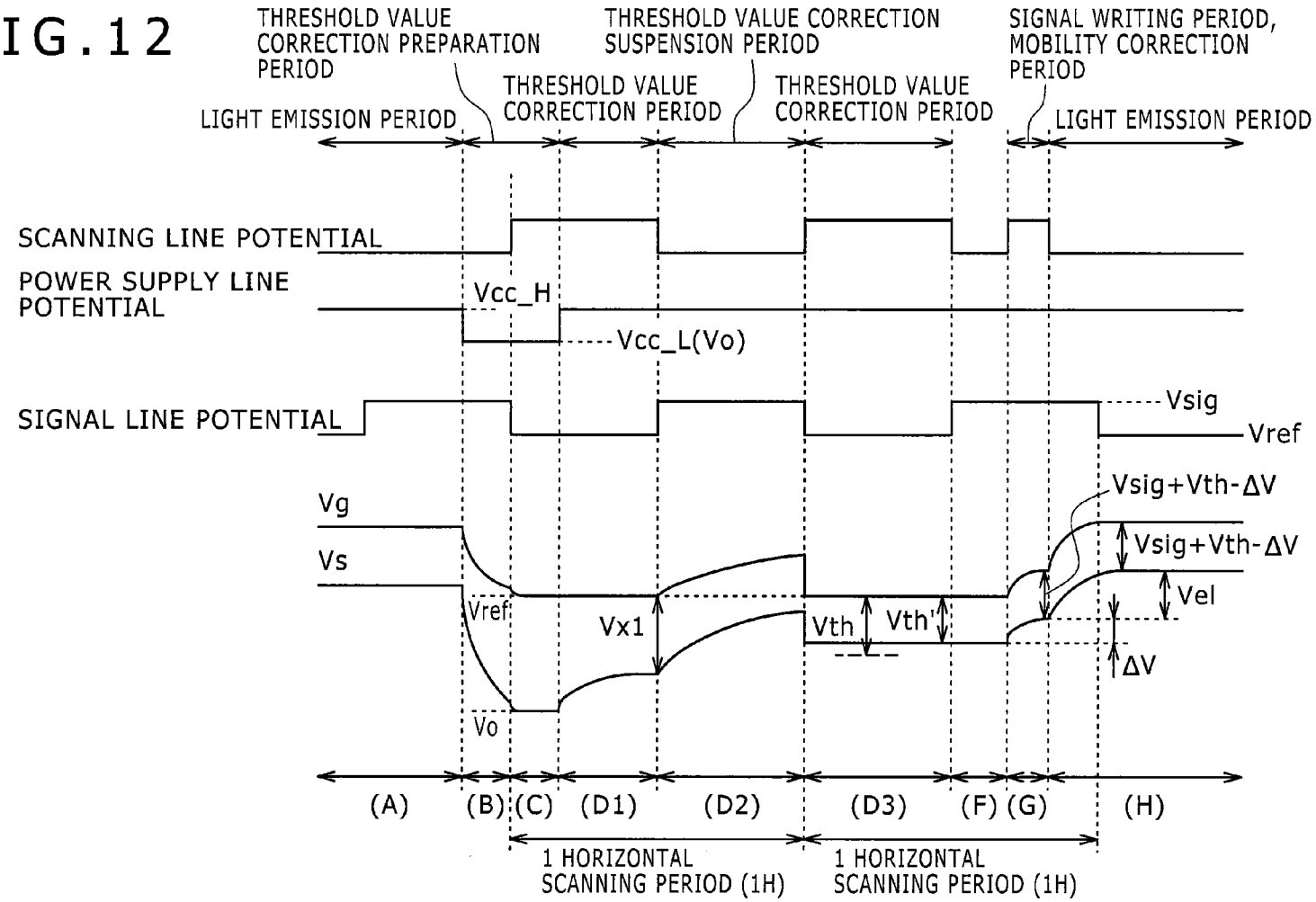
FIG. 12 is a similar view but illustrating overcorrection in threshold value correction.

However, upon bootstrap operation of the gate potential Vg, leak current and so forth have an influence, and strictly the hold voltage Vgs of the hold capacitor C11 decreases. Therefore, depending upon the magnitude of the hold voltage Vgs or the magnitude of a decreasing amount of the hold voltage Vgs at a point of time of the start of bootstrap operation, the hold voltage Vgs at the end of the bootstrap operation is lower than the original threshold voltage Vth. In other words, there is the possibility that overcorrection may occur as seen in FIG. 12.

Incidentally, if the hold voltage Vgs becomes lower than the original threshold voltage Vth as a result of overcorrection, then the driving transistor T12 continues its off state even after the threshold value correction operation is restarted. Therefore, the hold voltage Vgs of the hold capacitor C11 cannot converge to the correct correction value.

In particular, although execution of division of the threshold value correction period is effective for reduction of one horizontal scanning period, there is not a little possibility that, within a suspension period within which the driving transistors exhibits a floating state, the hold voltage Vgs may converge to a voltage value lower than the original correction value, that is, the original threshold voltage Vth.

(C-2) Solution 1

(a) Outline

Figure 13:
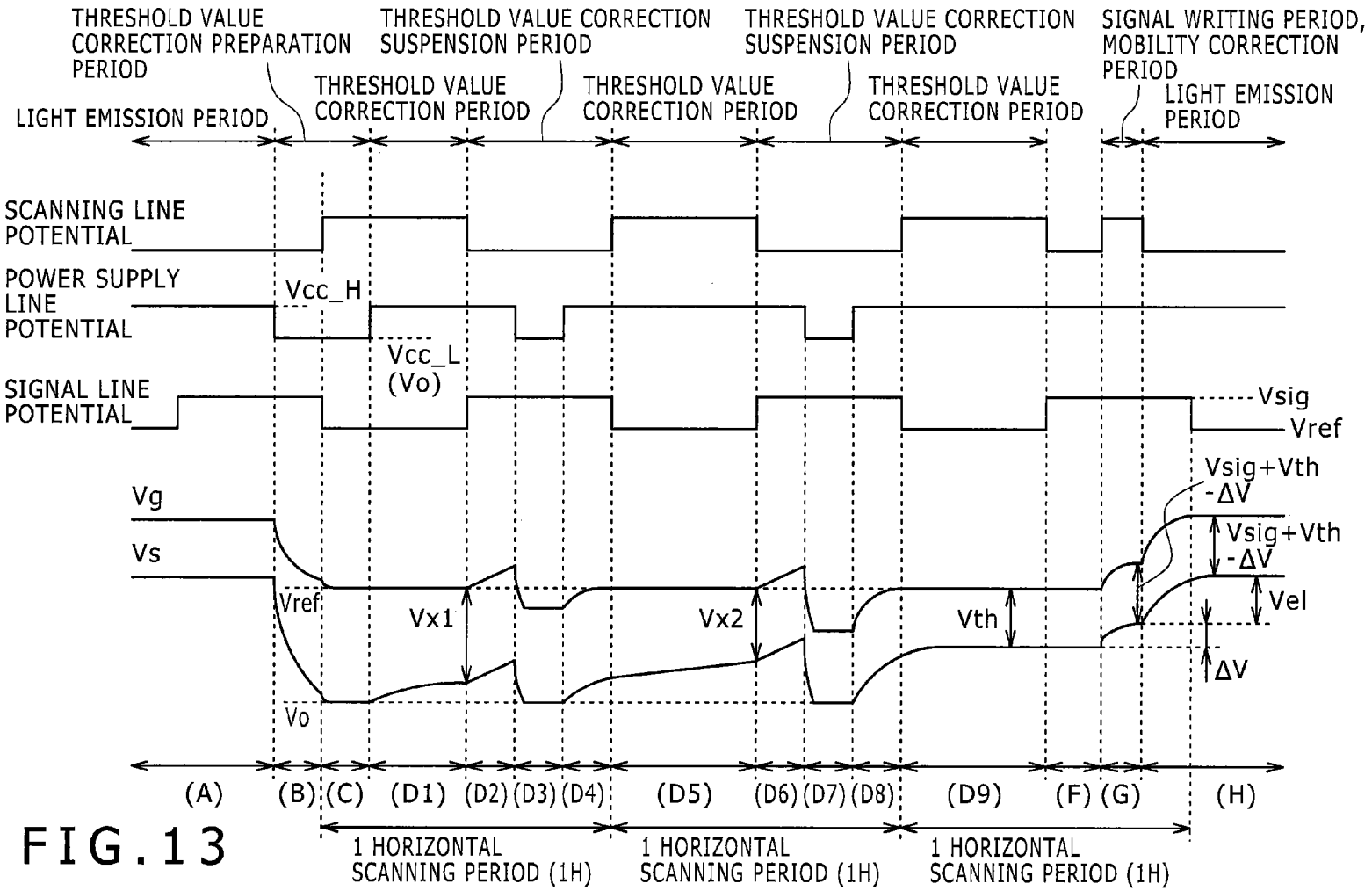
FIG. 13 is a similar view but illustrating an example of driving signals according to a solution 1.

Therefore, the inventors of the present invention propose such a driving method as illustrated in FIG. 13 in order to further improve the picture quality. FIG. 13 illustrates a driving method wherein the threshold value correction operation is executed over three horizontal scanning periods. In FIG. 13, like reference symbols are applied to those periods corresponding to the periods illustrated in FIG. 5.

Incidentally, to the period (D) corresponding to the threshold value correction period, serial numbers are applied to the individual sub periods.

In the present driving method, a period within which the potential of the power supply line 7(*i*) is compulsorily dropped to the second potential Vo for initialization is disposed within a threshold value correction suspension period within which the driving transistor T12 is placed into a floating state. In the case of FIG. 13, the period corresponds to periods (D3) and (D7).

In the present driving method, since the source potential Vs is initialized within the period (D3) and the period (D7), by adjusting the length of the periods (D4) and (D8) within which the first potential for lighting driving is applied to the power supply line 7(*i*), the gate potential Vg at the end of the period can be controlled to the gate potential Vg upon starting of the period.

Originally, drop of the hold voltage Vgs occurs when the gate potential Vg becomes higher than that upon starting of a threshold value correction suspension period. Accordingly, in the present driving method, bootstrap operation is stopped within a period within which the increasing amount of the gate potential Vg is small thereby to suppress drop of the hold voltage Vgs. In particular, the dropping amount of the hold voltage Vgs is suppressed to reduce the possibility of overcorrection significantly.

Further, since the hold voltage Vgs can be maintained also within the threshold value correction suspension period, correction operation can be continuously executed even during threshold value correction operation in succeeding operation cycles, and convergence of the hold voltage Vgs to the threshold voltage Vth can be made sure.

Naturally, supply of a power supply potential corresponding to the driving method is executed by the power supply scanner 17 corresponding to the supplying timing.

(b) Connection State in the Pixel Circuit and Variation of the Potential

In the following, connection states of the pixel circuit 13A and the variation of the potential of the pixel circuit 13A individually corresponding to the periods of FIG. 13 are described. Also here, like reference symbols are applied to those periods corresponding to the periods illustrated in FIG. 5. In other words, reference is had to FIGS. 14A to 14H.

It is to be noted that, in FIGS. 14A to 14H, the sampling transistor T11 is represented as a switch and the parasitic capacitance of the organic EL element D11 is represented explicitly as C12.

(i) Light Emission Period

Figure 14A:
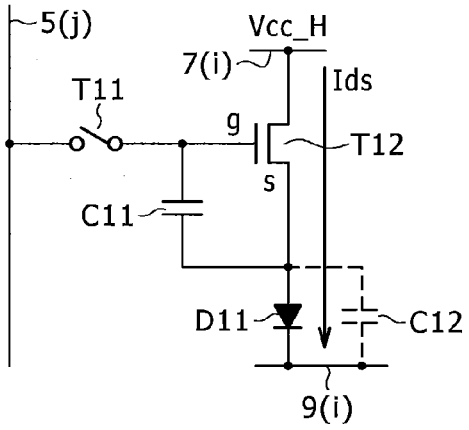

FIG. 14A corresponds to the operation state within the period (A) of FIG. 13. Within the period (A) which is a light emission period, the first potential Vcc_H for lighting driving is applied to the power supply line 7(*i*). At this time, the driving transistor T12 supplies drain current Ids corresponding to the hold voltage Vgs (>Vth) of the hold capacitor C11 to the organic EL element D11. The light emitting state of the organic EL element D11 continues till the end of the period (A).

(ii) Threshold Value Correction Preparation Period

Figure 14B:
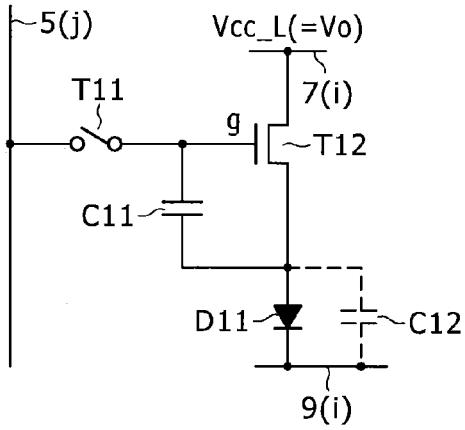

FIG. 14B corresponds to the operation state within the period (B) of FIG. 13. Within the period (B), the potential of the power supply line 7(*i*) is controlled so as to be changed over from the first potential Vcc_H for lighting driving to the second potential Vcc_L for initialization, that is, to the second potential Vo for initialization. By the changeover, the supply of the drain current Ids is interrupted.

As a result, the gate potential Vg and the source potential Vs of the driving transistor T12 drop in an interlocking relationship with a drop of the light emission voltage Vel of the organic EL element D11. Then, the source potential Vs drops to a potential substantially equal to the second potential Vo applied to the power supply line 7(*i*). It is to be noted that the second potential Vo is sufficiently lower than the reference voltage Vref for initialization applied to the 5(*j*).

Figure 14C:
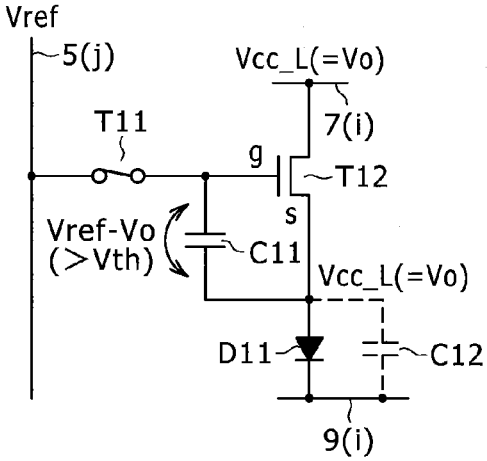

FIG. 14C corresponds to the operation state within the period (C) of FIG. 13. Within the period (C), the potential of the scanning line 3(*i*) varies to the high level. Consequently, the sampling transistor T11 is controlled to an on state, and the gate potential Vg of the driving transistor T12 is set to the reference voltage Vref for initialization applied to the signal line 5(*j*).

When the period (C) ends, the hold voltage Vgs of the hold capacitor C11 is initially set to a voltage higher than the threshold voltage Vth of the driving transistor T12. As a result, the driving transistor T12 is placed into an on state. It is to be noted that, if the drain current Ids is supplied to the organic EL element D11 at this point of time, then light having no relation to the signal potential Vsig is emitted.

Therefore, the organic EL element D11 is reversely biased by a high potential applied to the ground line 9. Accordingly, the drain current Ids flows to the signal line 5(*j*) through the hold capacitor C11 and the sampling transistor T11.

(iii) Threshold Value Correction Operation (First Time)

FIG. 14D1 corresponds to the operation state within the period (D1) of FIG. 13. Within the period (D1), the potential of the power supply line 7(*i*) changes from the second potential Vcc_L for initialization, that is, from the second potential Vo for initialization, to the first potential Vcc_H for lighting driving. It is to be noted that the sampling transistor T11 is maintained in an on state.

As a result, only the source potential Vs starts its rising while the gate potential Vg of the driving transistor T12 remains equal to the reference voltage Vref for initialization. Since one horizontal scanning period is short, the hold voltage Vgs of the hold capacitor C11 does not converge to the threshold voltage Vth at a point of time of the end of the period (D1). Here, the hold voltage Vgs at the point of the end is represented by Vx1.

(iv) Threshold Value Correction Suspension Operation (First Time)

FIG. 14D2 corresponds to the operation state within the period (D2) of FIG. 13. Within the period (D2), the potential of the scanning line 3(*i*) changes to the low level. Consequently, the gate electrode of the driving transistor T12 enters a floating state.

Also within this period, the potential of the power supply line 7(*i*) is maintained at the first potential Vcc_H for lighting driving. Further, the driving transistor T12 is maintained in an on state. As described hereinabove, the drain current flows so as to charge the parasitic capacitance C12 of the organic EL element D11 to raise the source potential Vs. Simultaneously, the gate potential Vg rises as a result of bootstrap operation.

FIG. 14D3 corresponds to the operation state within the period (D3) of FIG. 13. Within the period (D3), the potential of the power supply line 7(*i*) is changed over from the first potential for lighting driving to the second potential Vo for initialization. Consequently, the source potential Vs changes to the second potential Vo for initialization. As the source potential Vs drops, also the gate potential Vg drops by an equal amount.

FIG. 14D4 corresponds to the operation state within the period (D4) of FIG. 13. Within the period (D4), the potential of the power supply line 7(*i*) is changed over from the second potential Vo for initialization to the first potential for lighting driving. As a result, drain current flows from the driving transistor T12 to the parasitic capacitance C12 of the organic EL element D11 to raise the source potential Vs.

Simultaneously, the gate potential Vg rises as a result of bootstrap operation. However, since the time of the period (D4) is in an optimized state, the gate potential Vg at the end of the period converges to a potential substantially equal to that upon starting of the threshold value correction suspension period. As a result, the hold voltage Vgs is maintained in a state substantially same as that at the point of time of starting of the threshold value correction suspension period.

(v) Threshold Value Correction Operation (Second Time)

FIG. 14D5 corresponds to the operation state within the period (D5) of FIG. 13. Within the period (D5), the potential of the signal line 5(*j*) changes to the high level. Consequently, the reference voltage Vref for initialization is applied to the gate electrode of the driving transistor T12.

Meanwhile, the potential of the power supply line 7(*i*) is maintained at the first potential Vcc_H for lighting driving. Therefore, drain current begins to flow to the signal line 5(*j*) through the hold capacitor C11 and the sampling transistor T11 thereby to drop the hold voltage Vgs.

As a result, only the source potential Vs rises while the gate potential Vg of the driving transistor T12 remains equal to the reference voltage Vref for initialization.

Likewise, since one horizontal scanning period is short, at the point of time of the end of the period (D5), the hold voltage Vgs does not converge to the threshold voltage Vth. Here, the hold voltage Vgs at the point of time of the end is denoted by Vx2.

(vi) Threshold Value Correction Suspension Operation (Second Time)

FIG. 14D6 corresponds to the operation state within the period (D6) of FIG. 13. Within the period (D6), the potential of the scanning line 3(*i*) changes to the low level. Consequently, the gate electrode of the driving transistor T12 is placed into a floating state.

Also during this period, the potential of the power supply line 7(*i*) is maintained at the first potential Vcc_H for lighting driving. Therefore, the driving transistor T12 is maintained in an on state. Similarly as in the case described hereinabove, the drain current flows so as to charge the parasitic capacitance C12 of the organic EL element D11 thereby to raise the source potential Vs. Similarly, the gate potential Vg is raised by bootstrap operation.

FIG. 14D7 corresponds to the operation state within the period (D7) of FIG. 13. Within the period (D7), the potential of the power supply line 7(*i*) is changed over to the second potential Vo for initialization again. Consequently, the source potential Vs changes to the second potential Vo for initialization. As the source potential Vs drops, also the gate potential Vg drops by the same amount.

FIG. 14D8 corresponds to the operation state within the period (D8) of FIG. 13. Within the period (D8), the potential of the power supply line 7(*i*) is changed over from the second potential Vo for initialization to the first potential for lighting driving. As a result, drain current flows from the driving transistor T12 to the parasitic capacitance C12 of the organic EL element D11 thereby to raise the source potential Vs.

Simultaneously, the gate potential Vg rises as a result of bootstrap operation. However, since the time of the period (D8) is in an optimized state, the gate potential Vg at the end of the threshold value correction suspension period converges to a potential substantially same as that at the start of the period. As a result, the hold voltage Vgs is maintained at a substantially same level as that at the point of time of the start of the threshold value correction suspension period for the second time.

(vii) Threshold Value Correction Operation (Third Time)

FIG. 14D9 corresponds to the operation state within the period (D9) of FIG. 13. Within the period (D9), the potential of the signal line 5(*j*) changes to the high level again. Consequently, the reference voltage Vref for initialization is applied to the gate electrode of the driving transistor T12.

Meanwhile, the potential of the power supply line 7(*i*) is maintained at the first potential Vcc_H for lighting driving. Therefore, drain current flows out to the signal line 5(*j*) through the hold capacitor C11 and the sampling transistor T11 thereby to drop the hold voltage Vgs.

As a result, only the source potential Vs rises while the gate potential Vg of the driving transistor T12 remains equal to the reference voltage Vref for initialization.

Then, the hold voltage Vgs of the hold capacitor C11 converges to the threshold voltage Vth at some point of time till the end of the period (D9). Consequently, the driving transistor T12 is placed into an off state. The source potential Vs at this point of time is lower by the threshold voltage Vth than the gate potential Vg (=Vref).

Figure 14F:
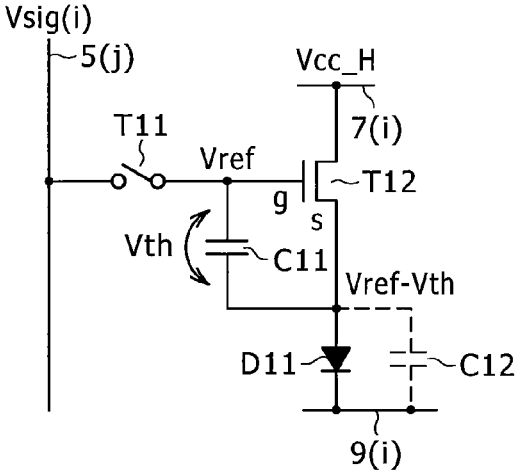

(viii) Preparation Operation for Writing of a Signal Potential and Correction of the Mobility FIG. 14F corresponds to the operation state within the period (F) of FIG. 13. Within the period (F), the scanning line 3(*i*) is changed over to the low level to control the sampling transistor T11 to an off state. Consequently, the gate electrode of the driving transistor T12 is disconnected from the signal line 5(*j*). In this state, the signal potential Vsig is applied to the signal line 5(*j*).

(ix) Writing of a Signal Potential and Correction Operation of the Mobility

Figure 14G:
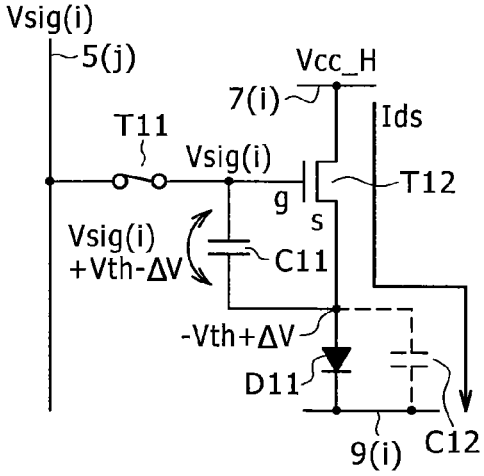

FIG. 14G corresponds to the operation state within the period (G) of FIG. 13. Within the period (G), the potential of the scanning line 3(*i*) varies to the high level. Consequently, the sampling transistor T11 is controlled to an on state, and the potential of the gate electrode of the driving transistor T12 changes to the signal potential Vsig.

Within the period (G), the potential of the power supply line 7(*i*) is the first potential Vcc_H for lighting driving. Accordingly, the driving transistor T12 is placed into an on state and drain current Ids begins to flow. However, the organic EL element D11 is in a cutoff state or high impedance state first. Therefore, the drain current Ids flows not into the organic EL element D11 but into the parasitic capacitance C12 as seen in FIG. 14G.

As the charging of the parasitic capacitance C12 progresses, the source potential Vs of the driving transistor T12 begins to rise. Soon, the hold voltage Vgs of the hold capacitor C11 becomes equal to Vsig+Vth−ΔV. In this manner, sampling of the signal potential Vsig and adjustment of the charge potential ΔV are executed in parallel. It is to be noted that, as the signal potential Vsig increases, also the drain current Ids increases and also the absolute value of the charge potential ΔV increases.

Consequently, mobility correction in accordance with the light emission luminance level can be achieved. It is to be noted that, where the signal potential Vsig is fixed, as the mobility μ of the driving transistor T12 increases, also the absolute value of the charge potential ΔV increases. This is because, as the mobility μ increases, the negative feedback amount increases.

(x) Writing of the Signal Potential and Correction Operation of the Mobility

Figure 14H:
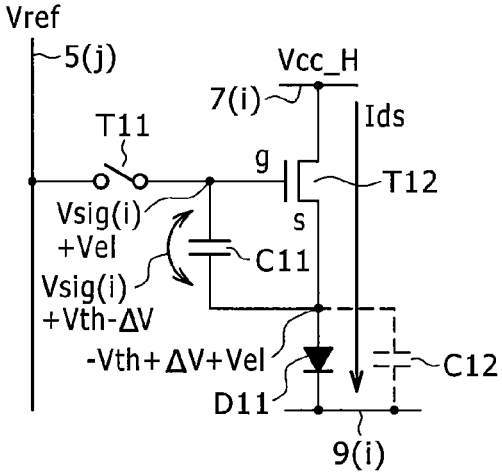

FIG. 14H corresponds to the operation state within the period (H) of FIG. 13. Within the period (H), the potential of the scanning line 3(*i*) changes to the low level again. Consequently, the sampling transistor T11 is controlled to an off state, and the gate electrode of the driving transistor T12 is placed into a floating state.

It is to be noted that, since the potential of the power supply line 7(*i*) is maintained at the first potential Vcc_H for lighting driving, drain current Ids corresponding to the hold voltage Vgs (=Vsig+Vth−ΔV) of the hold capacitor C11 is continuously supplied to the organic EL element D11. By the supply of the drain current, the organic EL element D11 begins to emit light. Simultaneously, a light emission voltage Vel corresponding to the magnitude of the drain current Ids appears between the two electrodes of the organic EL element D11.

In particular, the source potential Vs of the driving transistor T12 rises. Further, by bootstrap operation of the hold capacitor C11, the gate potential Vg rises by an amount equal to the rise amount of the source potential Vs. Thus, the hold voltage Vgs (=Vsig+Vth−ΔV) equal to that prior to the bootstrap operation is held in the hold capacitor C11. As a result, the light emitting operation by the drain current Ids after the mobility correction is continued.

(c) Effects of Correction

As described above, by applying a low potential, that is, the second potential for initialization, to the power supply line 7(*i*) to suppress the rise of the gate potential Vg by bootstrap operation within a suspension period of the threshold value correction operation wherein the driving transistor T12 operates in a floating state, drop of the hold voltage Vgs by leak current can be reduced significantly.

Consequently, the threshold value correction operation can be re-started while the hold voltage Vgs is maintained in a state wherein it is higher than the threshold voltage Vth. As a result, occurrence of abnormal light emission by overcorrection can be reduced significantly and further improvement of the picture quality can be implemented.

(C-3) Solution 2

(a) Outline

Here, a driving method by which better picture quality than that obtained by the driving method described above can be obtained is proposed.

Figure 15:
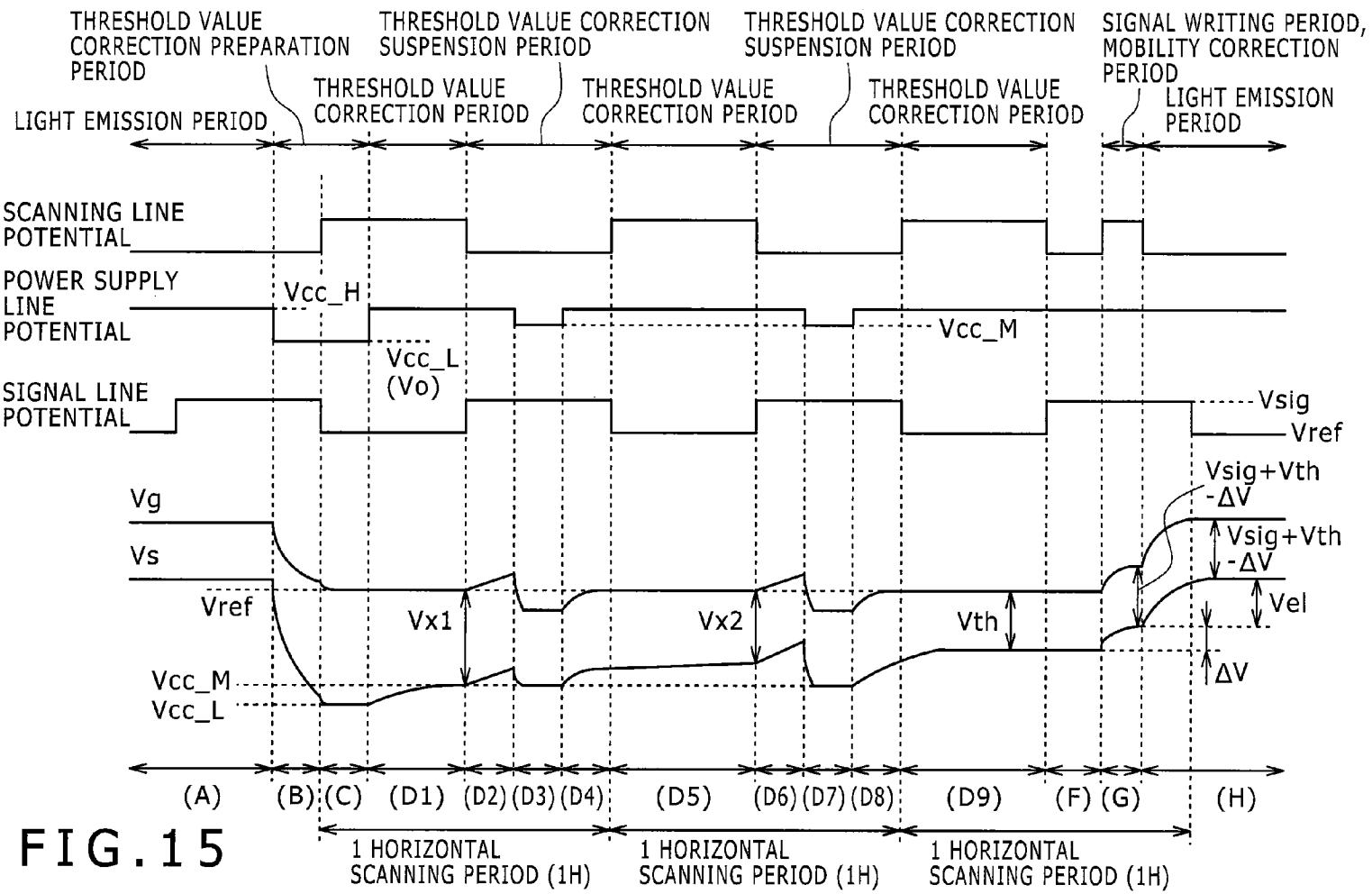
FIG. 15 is a timing chart showing an example of driving signals according to a solution 2.

FIG. 15 shows a timing chart corresponding to the driving method proposed here. Also in the driving method illustrated in FIG. 15, threshold value correction operation is executed over three horizontal scanning periods.

It is to be noted that like reference symbols are applied to those periods corresponding to the periods illustrated in FIG. 13.

Also the present driving method is similar to that of the solution 1 described hereinabove in that the potential of the power supply line 7(*i*) is compulsorily dropped within a threshold value correction suspension period within which the driving transistor T12 is controlled to a floating state.

However, in the case of this driving method, the dropping amount is set to one half that in the solution 1. In particular, the dropping amount is set to one half the potential difference between the first potential Vcc_H for lighting driving and the second potential Vo for initialization. In the following, the middle potential between the first potential Vcc_H and the second potential Vo is represented by Vcc_M.

Naturally, also in the case of the present driving method, since bootstrap operation can be suspended while the rising amount of the gate potential Vg remains small, reduction of the hold voltage Vgs can be suppressed.

In addition, the reduction width of the source potential Vs and the gate potential Vg in the periods (D3) and (D7) is one half that in the solution 1 described hereinabove. Therefore, the rising amount of the gate potential Vg upon bootstrap operation in the periods (D4) and (D8) hereinafter described can be reduced from that in the solution 1.

Further, as the variation amount of the gate potential Vg upon bootstrap operation increases, the leak current is likely to increase. However, in this driving method, since the rise of the potential can be re-started from a potential higher than that in the solution 1, the variation amount upon re-starting of the bootstrap operation can be suppressed small. Consequently, also the variation of the hold voltage Vgs in the periods (D4) and (D8) can be reduced.

(b) Configuration of the Power Supply Scanner and Driving Signals

Figure 16:
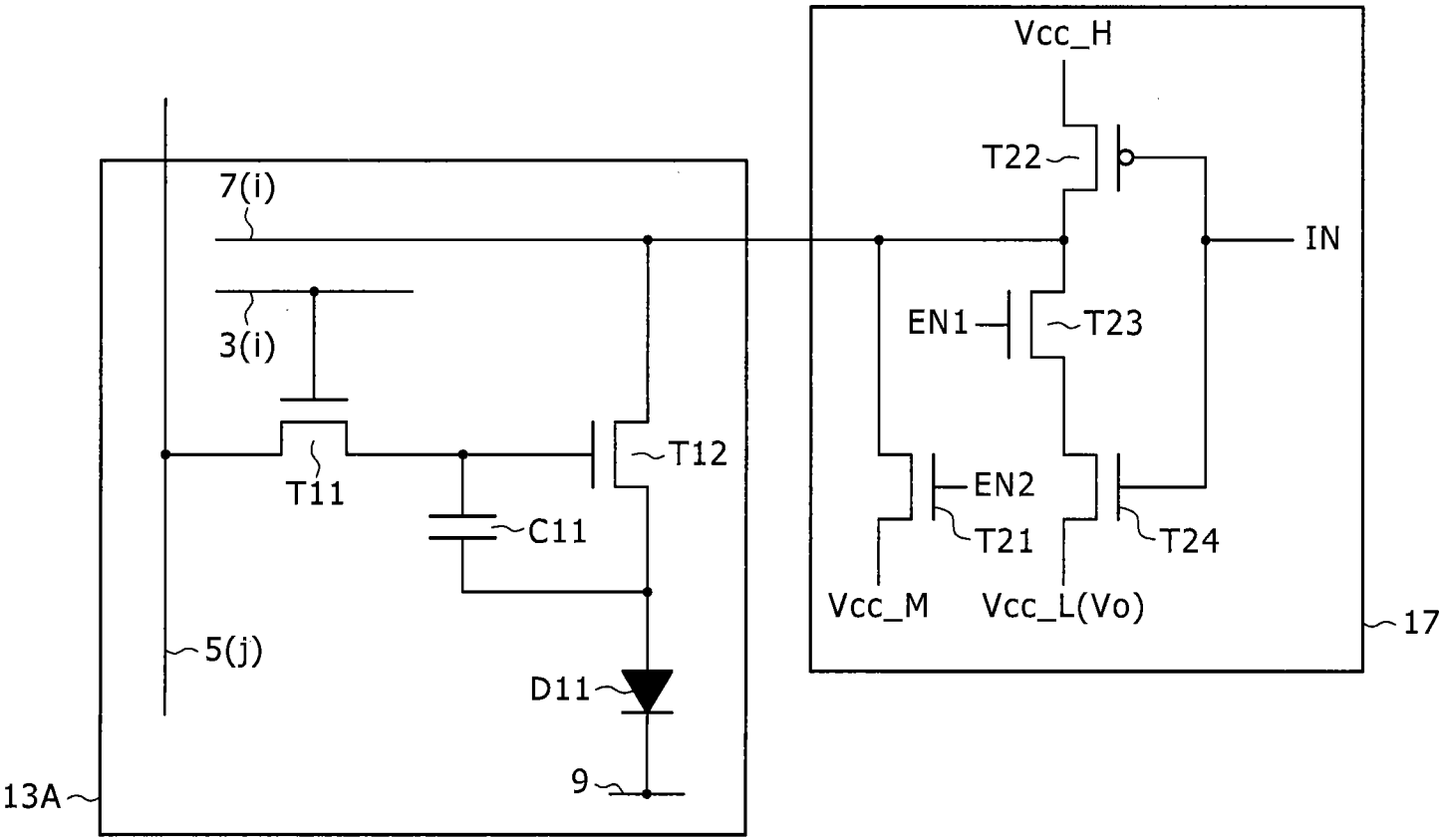
FIG. 16 is a circuit diagram showing an example of a circuit of a power supply scanner.
Figure 17:
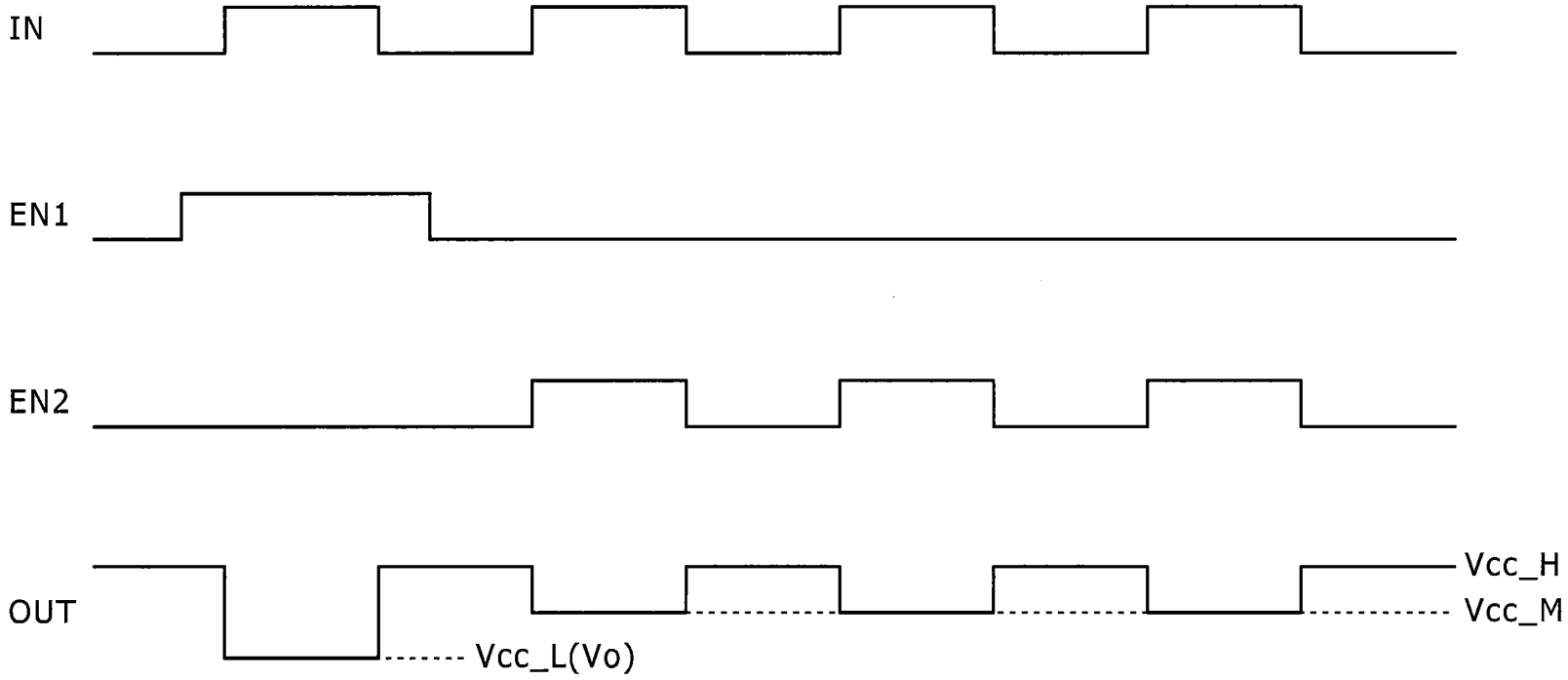
FIG. 17 is a waveform diagram illustrating an example of driving signals for the power supply scanner shown in FIG. 16.

FIG. 16 shows an example of a configuration of the power supply scanner 17 suitable for the driving method according to an embodiment of the present invention. FIG. 17 illustrates an example of driving signals of the power supply scanner 17 shown in FIG. 16.

In particular, FIG. 16 shows an internal structure of the power supply scanner 17 and particularly a connection scheme between the pixel circuit 13A and the power supply scanner 17.

In the driving method, the power supply scanner 17 is demanded to be capable of outputting a potential among three values.

An exemplary circuit configuration of the power supply scanner 17 is shown in FIG. 16. In the power supply scanner 17 shown in FIG. 16, the drain electrode of an N-channel type transistor T21, the drain electrode of a P-channel type transistor T22 and the drain of an N-channel type transistor T23 are connected to a power supply line 7(*i*).

A third potential Vcc_M is applied to the source electrode of the transistor T21. Accordingly, the transistor T21 functions as an application switch for the third potential Vcc_M.

Meanwhile, the first potential Vcc_H is applied to the source electrode of the transistor T22. Accordingly, the transistor T22 functions as an application switch for the first potential Vcc_H.

The drain electrode of an N-channel transistor T24 is connected to the source electrode of the transistor T23. Further, the second potential Vcc_L, that is, the second potential Vo, is applied to the source electrode of the transistor T24. A set of the transistor T23 and the transistor T24 functions as an application switch for the second potential Vcc_L.

For example, where the first potential Vcc_H is to be applied to the power supply line 7(*i*), a driving signal IN of the L level and another driving signal EN2 of the L level are supplied. Here, a further driving signal EN1 may be any of the L level and the H level.

Since the driving signal IN has the L level, the transistor T24 is always in an off state, and consequently, the second potential Vcc_L or Vo is not applied to the power supply line 7(*i*) irrespective of the operation state of the transistor T23.

Figure 18:
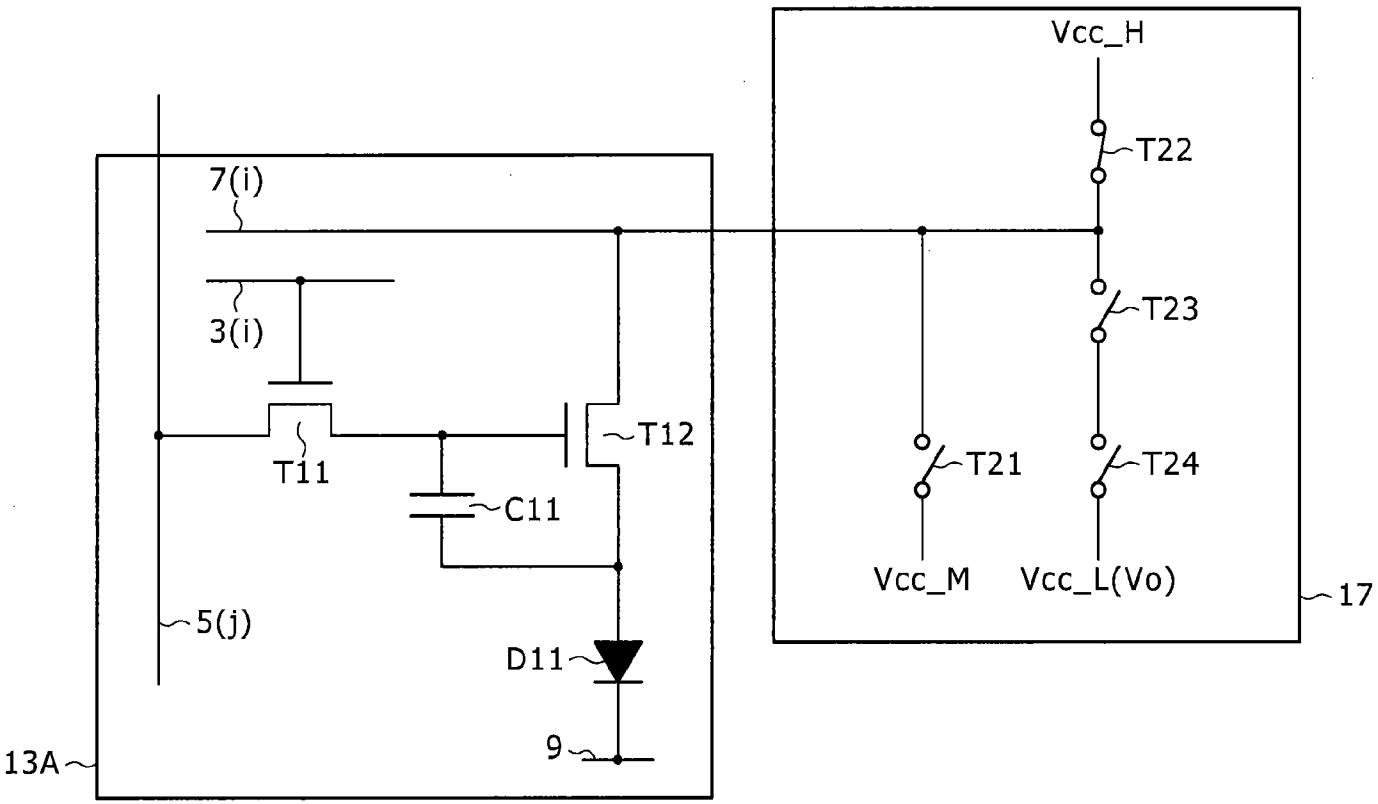
FIG. 18 is a circuit diagram illustrating an example of a driving signal where a first potential is applied to a power supply line.

FIG. 18 illustrates an example of open/closed states of the transistors in this instance. Incidentally, in the state illustrated in FIG. 18, the driving signal EN1 has the L level.

Figure 19:
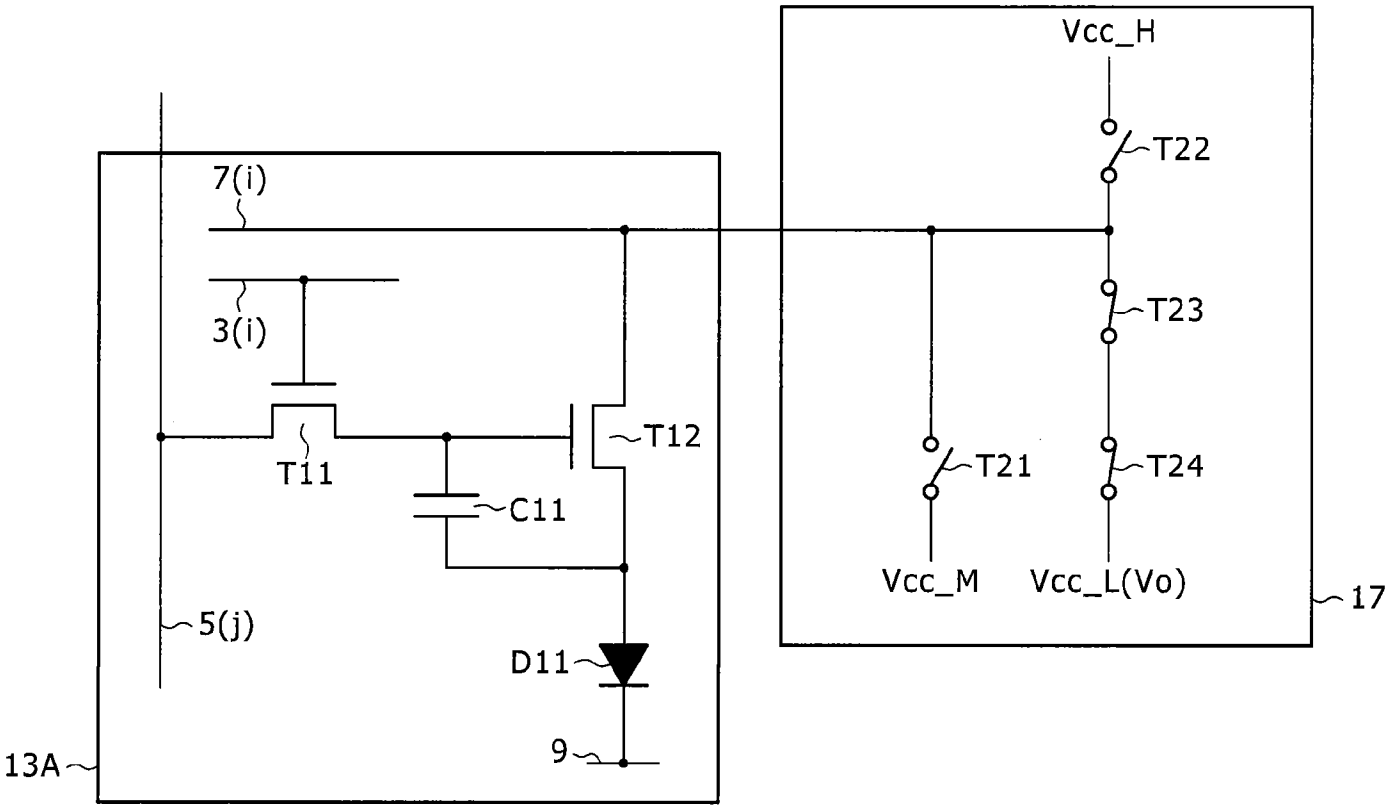
FIG. 19 is a similar view but illustrating an example of the driving signal where a second potential is applied to the power supply line.

For example, where the second potential Vcc_L is to be applied to the power supply line 7(*i*), the driving signal IN and the driving signal EN1 of the H level are supplied and the driving signal EN2 of the L level is supplied. In this instance, only the second potential Vcc_L or Vo is applied to the power supply line 7(*i*). FIG. 19 illustrates an example of open/closed states of the transistors in this instance.

Figure 20:
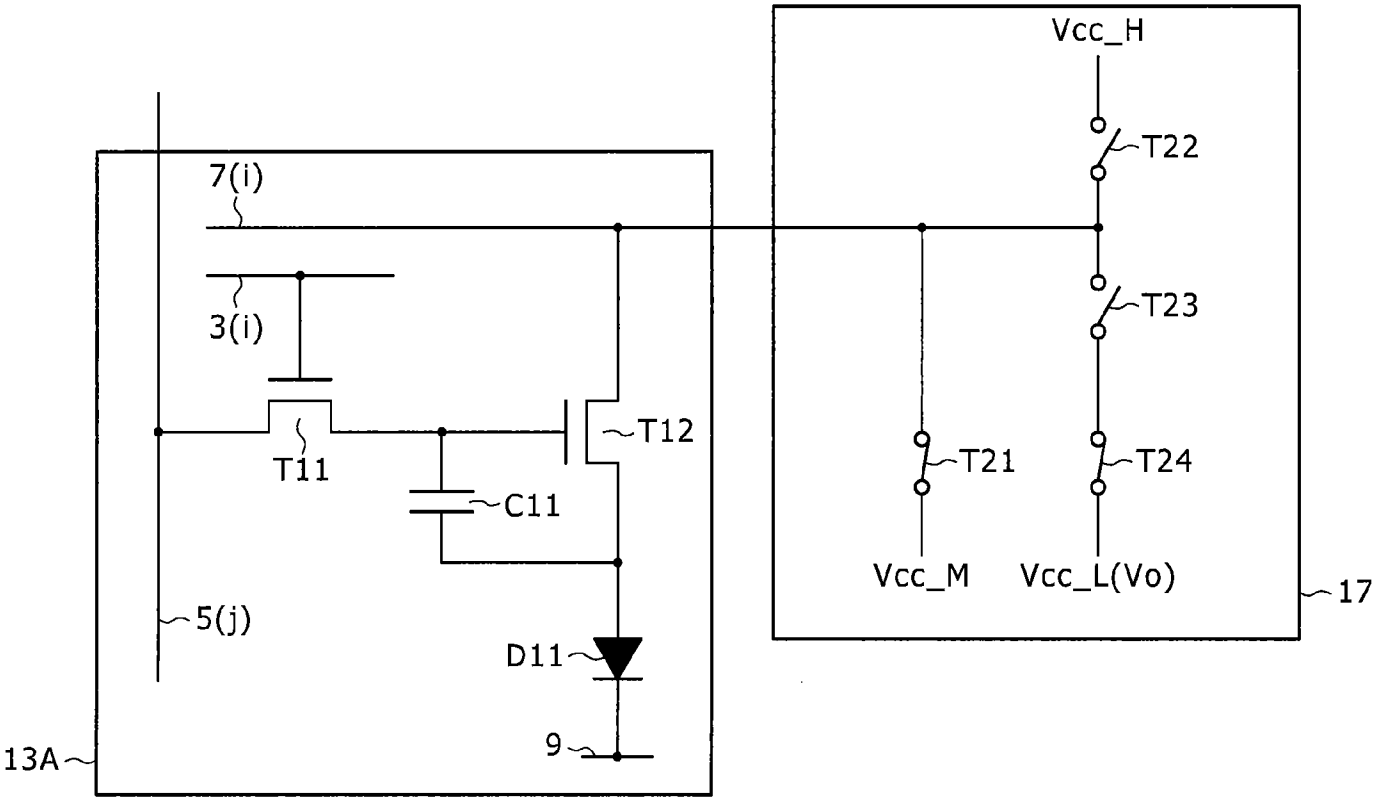
FIG. 20 is a similar view but illustrating an example of the driving signal where a third potential is applied to the power supply line.

For example, where the third potential Vcc_M is to be applied to the power supply line 7(*i*), the driving signal IN and the driving signal EN2 of the H level and the driving signal EN1 of the L level are supplied. In this instance, only the third potential Vcc_M or Vo is applied to the power supply line 7(*i*). FIG. 20 illustrates an example of open/closed states of the transistors in this instance.

(c) Effects of Correction

By applying the low potential, that is, the third potential for initialization, to the power supply line 7(*i*) within a suspension period of the threshold value correction operation wherein the driving transistor T12 operates in a floating state to suppress the rise of the gate potential Vg by bootstrap operation, drop of the hold voltage Vgs by leak current can be reduced significantly.

Further, in the present driving method, since the rise amount of the gate potential Vg upon re-starting of bootstrap operation may be smaller than that in the solution 1, the reduction width of the hold voltage Vgs during the operation can be further reduced. Further, since the variation width of the gate potential Vg upon bootstrap operation may be small, also the influence of the characteristic dispersion can be reduced.

Since drop of the hold voltage Vgs during suspension of threshold value correction is suppressed by a significant amount as described above, correction operation for a next operation cycle can be reduced from a voltage substantially equal to the hold voltage Vgs exhibited at the end of the correction operation in the preceding operation cycle. In other words, the threshold value correction operation can be re-started in a state wherein the hold voltage Vgs remains higher than the threshold voltage Vth. As a result, occurrences of abnormal light emission by overcorrection can be reduced significantly and further improvement in picture quality can be implemented.

(D) Other Configuration Examples (D-1) Different Driving Example 1 of the Power Supply Potential within a Threshold Value Correction Suspension Period In the driving example described above, the threshold value correction suspension period is divided into three sub periods, and the power supply potential is temporarily dropped only within a sub period in the proximity of the center of the threshold value correction suspension period.

In other words, within the first sub period and the third sub period from the top of the threshold value correction suspension period, that is, within the periods (D2) and (D4), the first potential Vcc_H for lighting driving is applied to the power supply line 7(*i*). Further, the length of the third sub period is set to a period of time necessary for the dropped gate potential Vg to rise to a potential equal to that upon starting of the threshold value correction suspension period by bootstrap operation.

However, variable methods may be applicable as a method for applying a potential lower than the first potential Vcc_H for lighting driving to the power supply line 7(*i*).

Figure 21:
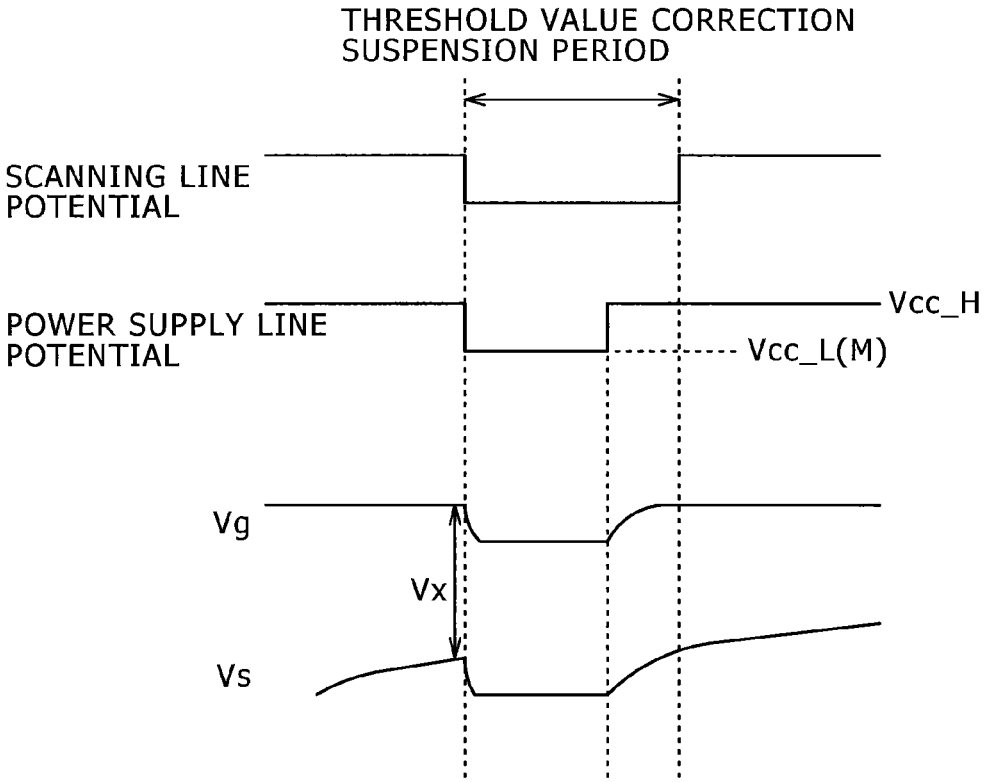
FIGS. 21 to 23 and 24A to 24E are timing charts illustrating different examples of application of a potential to the power supply line.

For example, such a driving method as illustrated in FIG. 21 may be adopted. In particular, according to the driving method illustrated in FIG. 21, the threshold value correction suspension period is divided into two sub periods, and a potential lower than the first potential Vcc_H for lighting driving is applied to the power supply line 7(*i*) within the top side sub period whereas the first potential Vcc_H is applied to the power supply line 7(*i*) within the tail side sub period.

Figure 22:
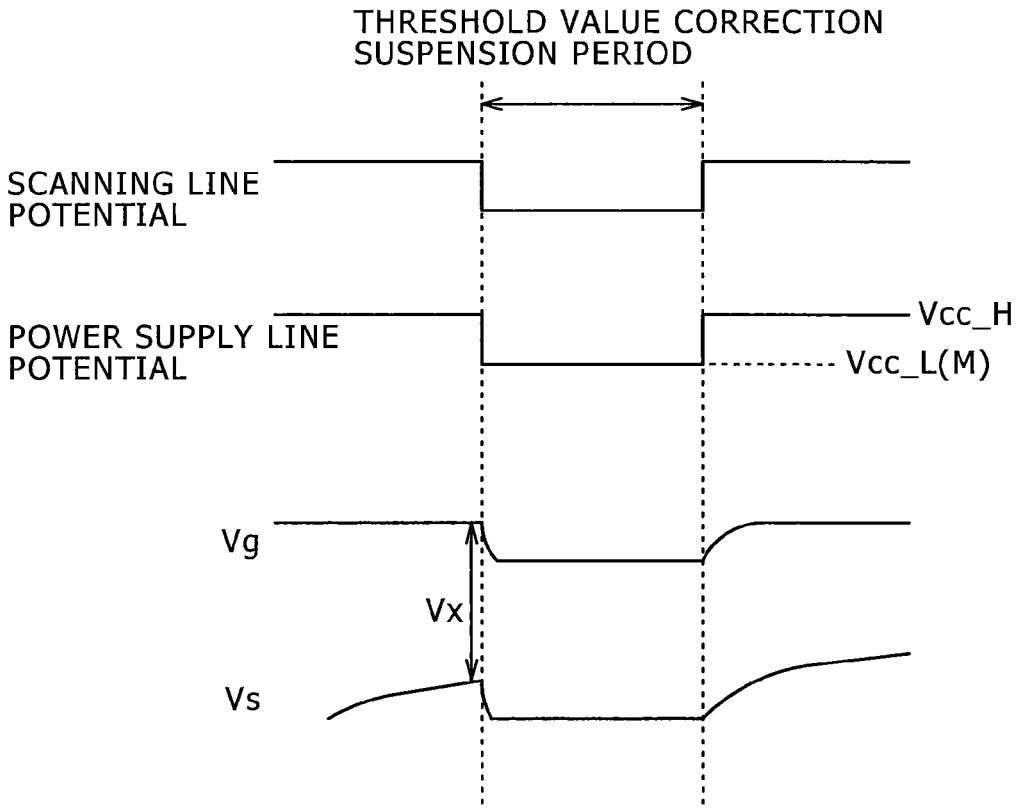

Or, another driving method illustrated in FIG. 22 may be adopted. In the driving method, a potential lower than the first potential Vcc_H for lighting driving is applied to the power supply line 7(*i*) within all sub periods of the threshold value correction suspension period.

Further, in the driving example described hereinabove, the application time of the first potential Vcc_H for lighting driving is set such that a next threshold value correction operation can be re-started with the gate potential Vg equal to the reference voltage Vref upon starting of the next threshold value correction suspension period.

Figure 23:
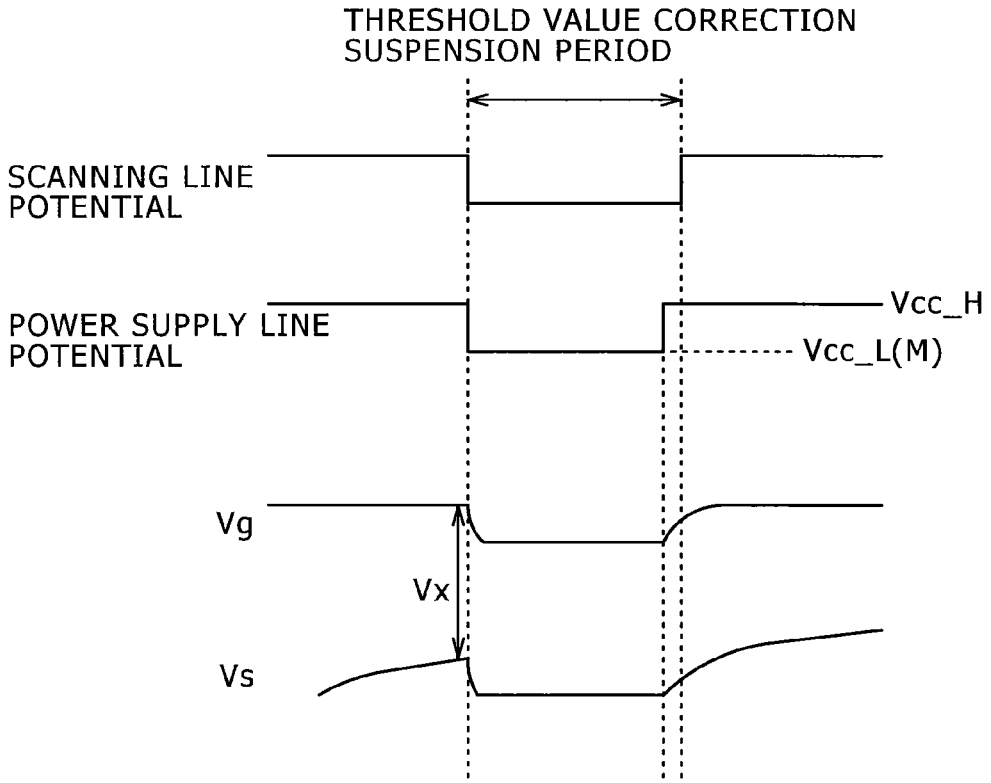

However, such a driving method as illustrated in FIG. 23 may be adopted instead. In particular, in the driving method, the time period within which the first potential Vcc_H for lighting driving is applied is shorter than the period of time necessary to return the gate potential Vg to the reference voltage Vref. In this instance, the time for returning the gate potential Vg to the reference voltage Vref is demanded upon re-starting of a threshold value correction period as seen in FIG. 23, and the time which can be used for reduction of the hold voltage Vgs decreases as much.

In particular, the time margin before the hold voltage Vgs converges to the threshold voltage Vth decreases. However, as the bootstrap operation period decreases, the drop of the hold voltage Vgs by an influence of leak current and so forth can be further reduced, and the possibility that overcorrection may occur can be reduced as much.

(D-2) Different Driving Example 2 of the Power Supply Potential within a Threshold Value Correction Suspension Period In the driving example described hereinabove, the potential to be applied to the power supply line 7(*i*) within a threshold value correction suspension period is set from the first potential Vcc_H for lighting driving to the second potential Vcc_L or Vo for initialization or the third potential Vcc_M which is a middle value between the first potential Vcc_H and the second potential Vcc_L.

However, the application voltage for interruption of bootstrap operation may be an intermediate potential between the first potential Vcc_H for lighting driving and the second potential Vcc_L or Vo for initialization as seen in FIG. 24.

Figures 24A, 24B, 24C, 24D, 24E:
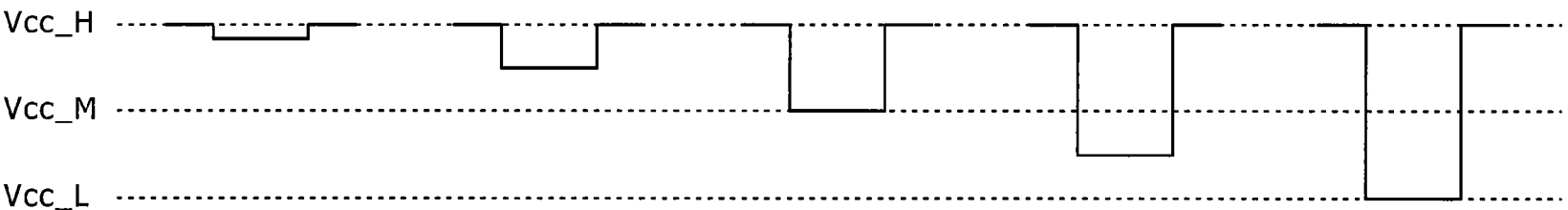

Incidentally, the application voltage indicated in FIG. 24E corresponds to the solution 1, and the application voltage indicated in FIG. 24C corresponds to the solution 2.

The application voltage for interruption of bootstrap operation may be lower than the third potential Vcc_M as seen from FIG. 24D or may be higher than the third potential Vcc_M as seen from FIG. 24A or 24B.

It is to be noted that, if the drop amount for the first potential for lighting driving is excessively small, then also after the rise of the gate potential Vg by bootstrap operation drops temporarily, the bootstrap operation is started. Therefore, the actual application voltage must be selected appropriately in response to the relationship of the driving voltages.

However, when compared with an alternative case wherein the first potential for lighting driving continues to be applied, the interruption effect of bootstrap operation and the suppression effect of the rising speed can be amplified although they may be temporary.

(D-3) Division Number of the Threshold Value Correction Operation

In the case of the driving method described above, the threshold value correction period is divided into two sub periods or three periods.

However, depending upon the length of one horizontal scanning period or upon the relationship of the length of one horizontal scanning period and the signal writing period, the divisional sub period number may be four or more.

(D-4) Pixel Structure

In the driving method described above, both of the two thin film transistors of the pixel circuit 13A are of the N channel type.

Figure 25:
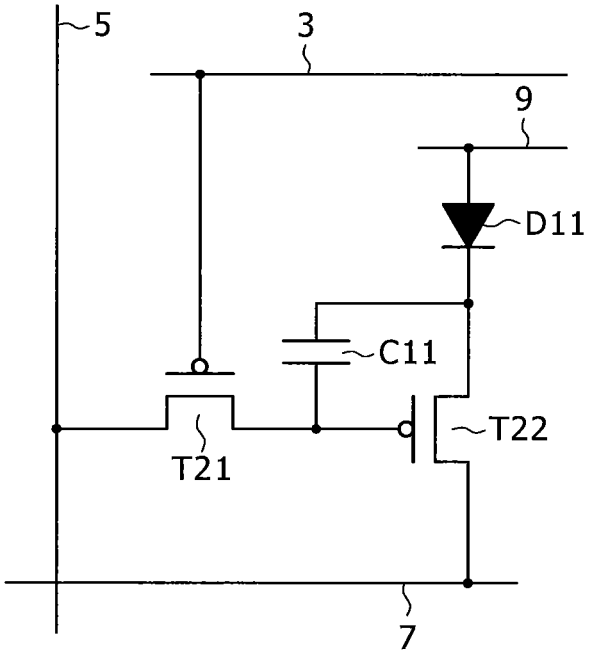
FIG. 25 is a circuit diagram showing a different example of a pixel circuit.

However, both of the thin film transistors may be of the P type as seen in FIG. 25.

In this instance, the potential to be applied to the power supply line 7(*i*) is reversed from that described hereinabove. In particular, the first potential for lighting driving is provided as a potential lower than the second potential for initialization. Accordingly, in this instance, the potential to be applied to the drain electrode of the driving transistor within some of sub periods of the threshold value correction suspension period may be set to a potential higher than the first potential for lighting driving.

(D-5) Example of Products (a) Drive IC

In the foregoing description, the pixel array section and the driving circuits are formed on one panel.

However, the pixel array section and the driving circuits may be fabricated and distributed separately from each other. For example, it is possible to fabricate each of the driving circuits as an independent drive IC (integrated circuit) and distribute them independently of an inorganic EL panel.

(b) Display Module

Figure 26:
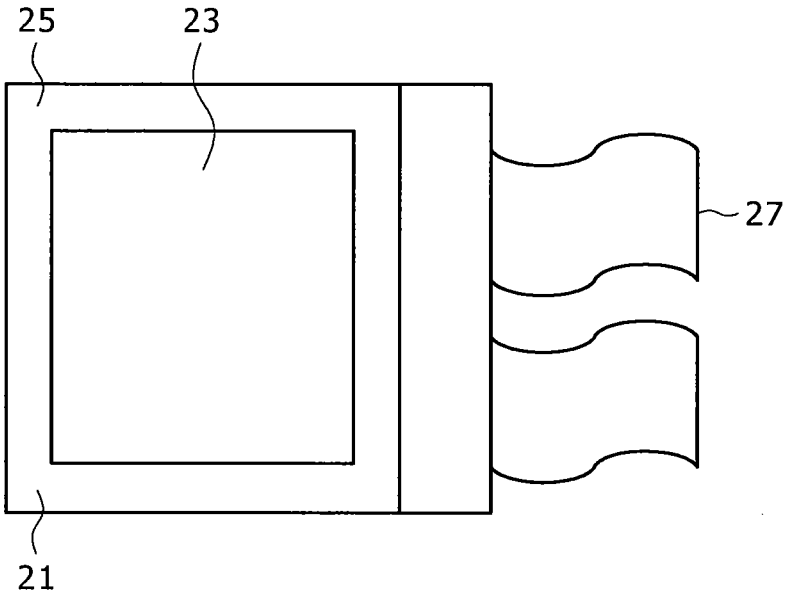
FIG. 26 is a plan view showing an example of a configuration of a display module.

The organic EL display device of the embodiment described above may be distributed in the form of a display module 21 having an appearance configuration shown in FIG. 26.

The display module 21 is structured such that an opposing section 23 is adhered to the surface of a support board 25. The opposing section 23 includes a substrate in the form of a transparent member made of glass or the like, and a color filter, a protective film, a light blocking film and so forth disposed on the surface of the substrate.

It is to be noted that a flexible printed circuit (FPC) 27 or the like for inputting and outputting a signal and so forth from and to the outside to and from the support board 25.

(c) Electronic Apparatus

The organic EL display device of the embodiment described above may be distributed also in the form of a commodity wherein it is incorporated in an electronic apparatus.

Figure 27:
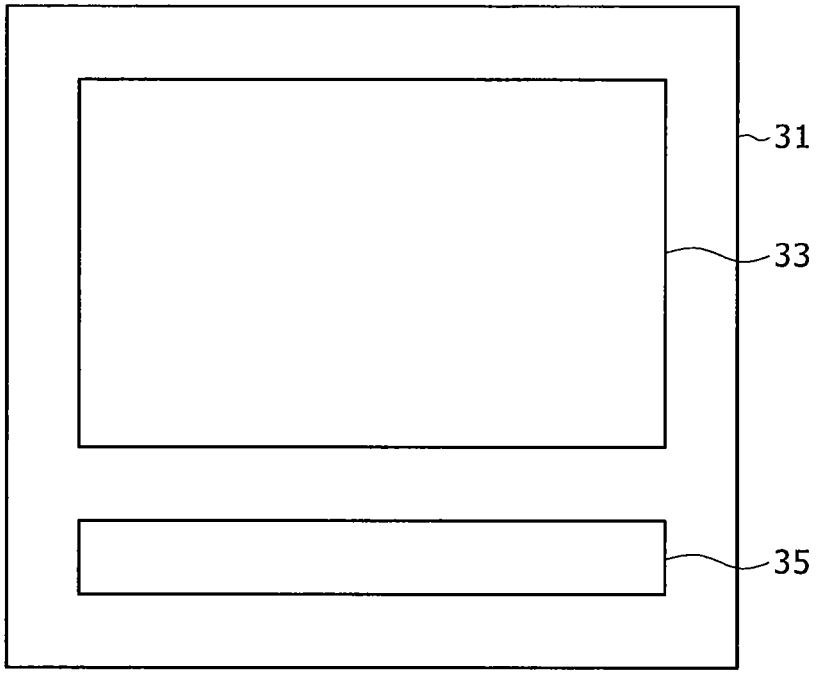
FIG. 27 is a schematic view showing an example a functional configuration of an electronic apparatus.

FIG. 27 illustrates a concept of an example of a configuration of an electronic apparatus 31. The electronic apparatus 31 includes an organic EL display device 33 having such a configuration as described hereinabove and a system control section 35. The substance of processing executed by the system control section 35 differs among different commodity forms of the electronic apparatus 31.

It is to be noted that the electronic apparatus 31 is not restricted to apparatus in a specific field if it incorporates a function of displaying an image generated in the electronic apparatus 31 itself or inputted from the outside.

Figure 28:
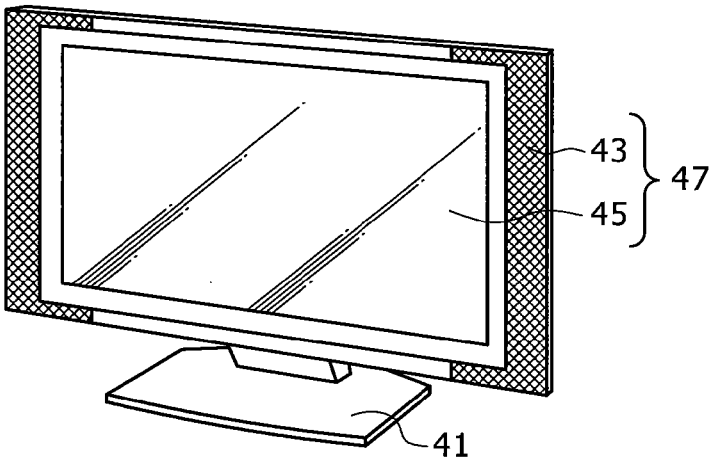
FIG. 28 is a perspective view showing a television set as a form of the electronic apparatus.

The electronic apparatus 31 may be formed, for example, as a television receiver. FIG. 28 shows an example of an appearance of the television receiver 41.

A display screen 47 formed from a front panel 43, a filter glass plate 45 and so forth is disposed on the front of a housing of the television receiver 41. The display screen 47 corresponds to the organic EL display device described hereinabove as the embodiment of the present invention.

Figure 29A:
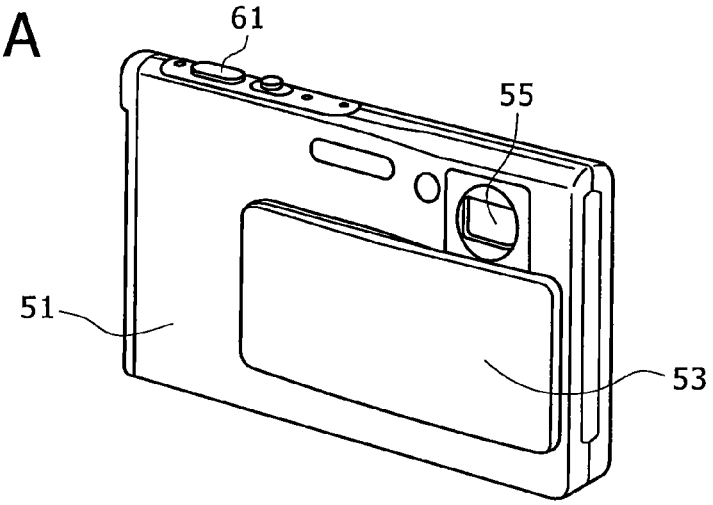
FIGS. 29A and 29B are perspective views showing a digital still camera as another form of the electronic apparatus.
Figure 29B:
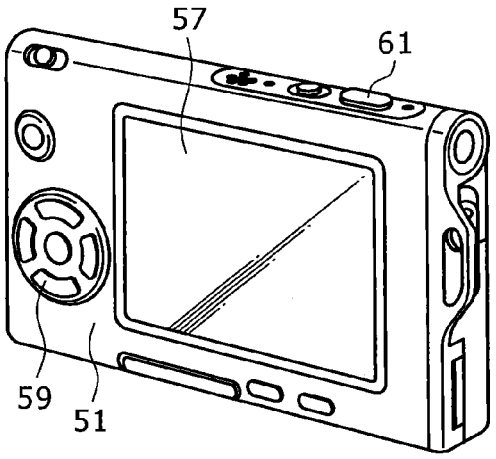

The electronic apparatus 31 may otherwise be formed, for example, as a digital camera. FIGS. 29A and 29B show an example of an appearance of the digital camera 51. In particular, FIG. 29A shows an example of an appearance of the front side, that is, the image pickup object side, of the digital camera 51, and FIG. 29B shows an example of an appearance of the rear side, that is, the image pickup person side, of the digital camera 51.

The digital camera 51 includes an image pickup lens disposed on the rear side of or covered with a protective cover 53 which is in a closed state in FIGS. 29*a* and 29*b* such that the image pickup lens is not exposed. The digital camera 51 further includes a flash light emitting section 55, a display screen 57, control switches 59 and a shutter button 61. The display screen 57 corresponds to the organic EL display device described hereinabove as the embodiment of the present invention.

Figure 30:
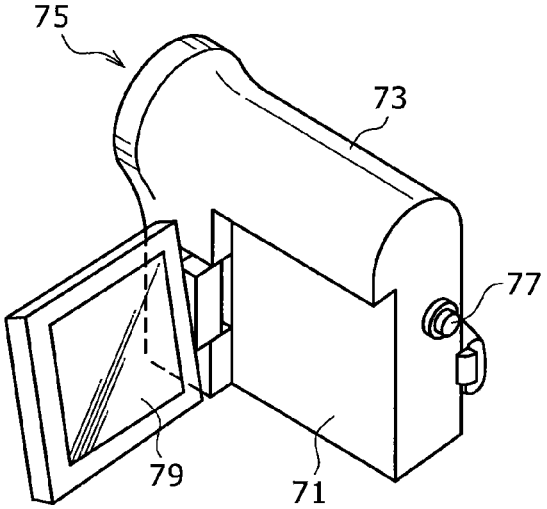
FIG. 30 is a perspective view showing a video camera as a further form of the electronic apparatus.

Further, the electronic apparatus 31 may be formed, for example, as a video camera. FIG. 30 shows an example of an appearance of the video camera 71.

The video camera 71 includes an image pickup lens 75 for picking up an image of an image pickup object, a start/stop switch 77 for starting and suspension image pickup, and a display screen 79 disposed on the front side of a body 73 thereof. The display screen 79 corresponds to the organic EL display device described hereinabove as the embodiment of the present invention.

Figure 31A:
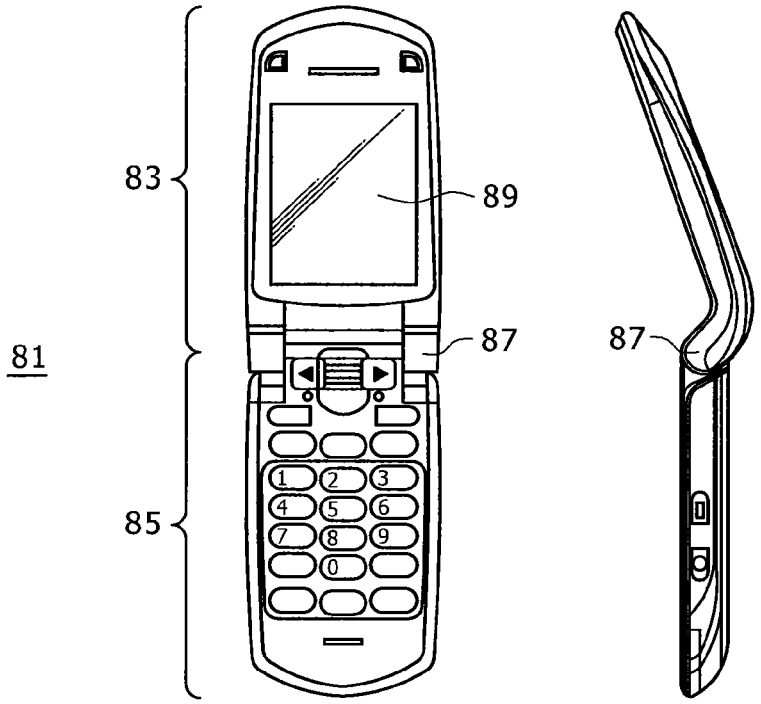
FIGS. 31A and 31B are schematic views showing a portable terminal device as a still further form of the electronic apparatus.
Figure 31B:
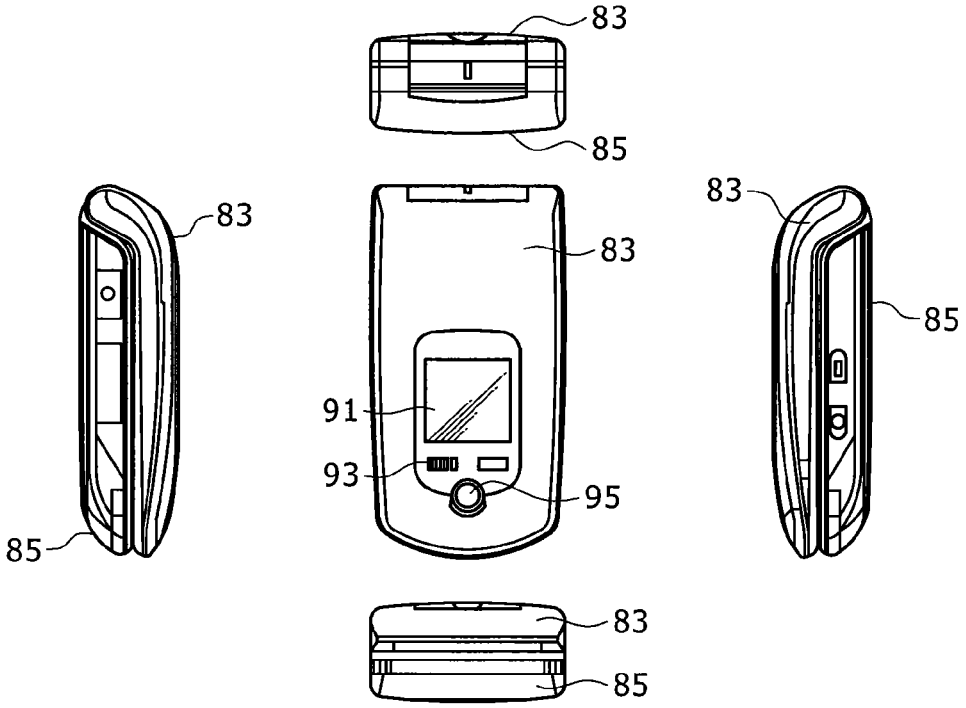

Further, the electronic apparatus 31 may be formed, for example, as a portable terminal device. FIGS. 31A and 31B show an example of an appearance of a portable telephone set 81 as the portable terminal device. The portable telephone set 81 shown in FIGS. 31A and 31B is of the foldable type, and FIG. 31A shows an example of an appearance of the portable telephone set 81 in a state wherein a housing thereof is opened while FIG. 31B shows an example of an appearance of the portable telephone set 81 in another state wherein the housing thereof is closed.

The portable telephone set 81 includes an upper side housing 83, a lower side housing 85, a connection section 87 in form of a hinge section, a display screen 89, an auxiliary display screen 91, a picture light 93 and an image pickup lens 95. The display screen 89 and the auxiliary display screen 91 correspond to the organic EL display device described hereinabove as the embodiment of the present invention.

Figure 32:
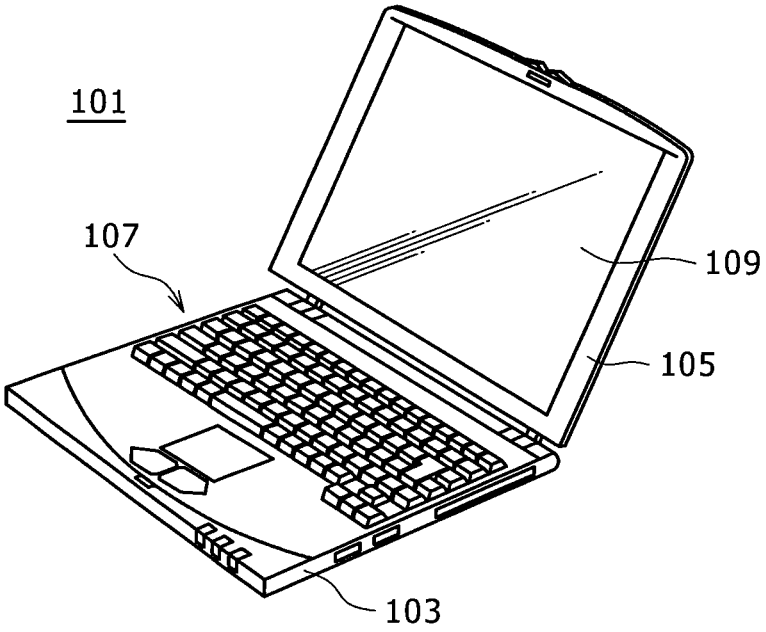
FIG. 32 is a perspective view showing a notebook type personal computer as a yet further form of the electronic apparatus.

Furthermore, the electronic apparatus 31 may be formed, for example, as a computer. FIG. 32 shows an example of an appearance of a notebook type computer 101.

The notebook type computer 101 includes a lower side housing 103, an upper side housing 105, a keyboard 107, and a display screen 109. The display screen 109 corresponds to the organic EL display device described hereinabove as the embodiment of the present invention.

Further, the electronic apparatus 31 may be applied to an audio reproduction device, a game machine, an electronic book, an electronic dictionary and so forth.

(D-6) Other Examples of a Display Device

The driving method described hereinabove may be applied also to a self-luminous display panel other than the organic EL panel. For example, the driving method can be applied to an inorganic EL panel, a display panel on which LEDs are arrayed and a display panel wherein light emitting elements having any other diode structure are arrayed on a screen.

(D-7) Others

The embodiment described above may be modified in various forms without departing from the spirit and scope of the present invention. Also various modifications and applications may be possible which are created or combined based on the disclosure of the present invention.

What is claimed is:

1. A display apparatus comprising:

a pixel circuit including a driving transistor, a light emitting element, a sampling transistor, and a capacitor configured to hold an image signal provided through the sampling transistor in a given writing cycle, the driving transistor including a drain electrode and being configured to supply drain current corresponding to the image signal held in the capacitor to the light emitting element, wherein a correction operation for a characteristic of the drive transistor is performed for the given writing cycle; and a driving circuit configured to control a potential to be applied to the drain electrode of the driving transistor to an intermediate potential within a suspension period of the correction operation, the intermediate potential being between a first potential for lighting the light emitting element and a second potential for initialization of the light emitting element, the suspension period being between a first correction period of the correction operation and a second correction period of the correction operation.

2. The display apparatus according to claim 1, wherein the intermediate potential is equal to a mid-point potential between the first potential and the second potential.

3. The display apparatus according to claim 1, wherein applying the intermediate potential to the drain electrode is started simultaneously with a point of time of an end of the first correction period.

4. The display apparatus according to claim 1, wherein applying the intermediate potential to the drain electrode is stopped at a timing at which a gate potential of the driving transistor is changed to a reference potential for threshold value correction before a point of time of a start of the second correction operation.

5. A display apparatus comprising:

a pixel circuit including a driving transistor, a light emitting element, a sampling transistor, and a capacitor configured to hold an image signal provided through the sampling transistor in a given writing cycle, the driving transistor including a drain electrode and being configured to supply drain current corresponding to the image signal held in the capacitor to the light emitting element, wherein a correction operation for a characteristic of the drive transistor is performed for the given writing cycle; and a driving circuit configured to switch a potential to be applied to the drain electrode of the driving transistor to an intermediate potential within a suspension period of the correction operation, the intermediate potential being between a first potential for lighting the light emitting element and a second potential for initialization of the light emitting element, the suspension period being between a first correction period of the correction operation and a second correction period of the correction operation.

6. The display apparatus according to claim 5, wherein the intermediate potential is equal to a mid-point potential between the first potential and the second potential.

7. An electronic device comprising the display apparatus according to claim 1.

8. The electronic device according to claim 7, wherein the intermediate potential is equal to a mid-point potential between the first potential and the second potential.

9. The electronic device according to claim 7, wherein applying the intermediate potential to the drain electrode is started simultaneously with a point of time of an end of the first correction period.

10. The electronic device according to claim 7, wherein applying the intermediate potential to the drain electrode is stopped at a timing at which a gate potential of the driving transistor is changed to a reference potential for threshold value correction before a point of time of a start of the second correction operation.

* * * * *